US008511437B2

(12) United States Patent
Glaser

(10) Patent No.: US 8,511,437 B2
(45) Date of Patent: Aug. 20, 2013

(54) ELEVATOR CAR BRAKE WITH SHOES ACTUATED BY SPRINGS COUPLED TO GEAR DRIVE ASSEMBLY

(75) Inventor: Walter Glaser, Bronx, NY (US)

(73) Assignee: Hollister-Whitney Elevator Corp., Quincy, IL (US)

( * ) Notice: Subject to any disclaimer, the term of this patent is extended or adjusted under 35 U.S.C. 154(b) by 461 days.

(21) Appl. No.: 12/386,174

(22) Filed: Apr. 14, 2009

(65) Prior Publication Data

US 2009/0294220 A1 Dec. 3, 2009

Related U.S. Application Data

(60) Provisional application No. 61/125,038, filed on Apr. 21, 2008.

(51) Int. Cl.
*B65H 59/28* (2006.01)

(52) U.S. Cl.
USPC ..... 188/65.2; 188/43; 188/65.1; 188/67; 188/71.1; 188/71.5; 188/161; 188/137; 188/188; 188/189; 187/254; 187/305; 187/350; 187/355; 187/366; 187/375; 187/376

(58) Field of Classification Search
USPC ..... 188/65.1–65.2, 180, 188–189; 187/350
See application file for complete search history.

(56) References Cited

U.S. PATENT DOCUMENTS 2,511,697 A 6/1950 Clift
3,327,811 A * 6/1967 Mastroberte ..... 187/305
4,462,487 A 7/1984 Warwick et al.
4,838,622 A 6/1989 Kircher et al.
5,101,937 A * 4/1992 Burrell et al. ..... 187/350

(Continued)

FOREIGN PATENT DOCUMENTS

EP 1733992 A1 12/2006
JP 06211472 A 8/1994

(Continued)

OTHER PUBLICATIONS

International Search Report Issued in corresponding PCT Application PCT/US 09/02299 on Jun. 11, 2009.

(Continued)

*Primary Examiner* — Robert A Siconolfi
*Assistant Examiner* — San Aung
(74) *Attorney, Agent, or Firm* — Lerner, David, Littenberg, Krumholz & Mentlik, LLP

(57) ABSTRACT

An elevator car braking apparatus includes a gear drive assembly for compressing one or more springs which are coupled by a cam follower to one or a pair of brake shoes. When the springs are released from a compressed state, the brake shoes engage and grip hoisting ropes, part of the hoisting apparatus or the car guide rails, within a predetermined time from the start of a brake application cycle. During a brake application cycle, the springs move the cam follower along cam surfaces shaped and disposed to cause the cam follower to move at least one of the brake shoes toward the other brake shoe. The gear assembly includes clutch means for disengaging from and engaging with a gear or axle of the gear assembly during decompression and compression of the springs, respectively. A resilient material in the braking apparatus initially accelerates movement of the cam follower when the springs begin to decompress, and may protect gears of the gear assembly from damage at the end of a brake release cycle.

23 Claims, 28 Drawing Sheets

(56) References Cited

U.S. PATENT DOCUMENTS

| | | | | |
|---|---|---|---|---|
| 5,228,540 | A * | 7/1993 | Glaser | 187/355 |
| 5,366,045 | A * | 11/1994 | Liston | 187/376 |
| 2006/0118366 | A1* | 6/2006 | Eckenstein et al. | 188/65.1 |
| 2007/0007083 | A1* | 1/2007 | Husmann | 187/366 |

FOREIGN PATENT DOCUMENTS

| | | | |
|---|---|---|---|
| SU | 819031 | A1 | 4/1981 |
| TW | 200744935 | | 12/2007 |
| WO | 2006/078081 | A1 | 7/2006 |

OTHER PUBLICATIONS

European Search Report, EP 09158259, dated Jul. 27, 2009.

Office Action from Taiwanese Application No. 098113223 dated Oct. 26, 2011.

Japanese Office Action for Application No. 2009-102266 dated Oct. 2, 2012.

Russian Decision on Grant for application No. 2010147361 dated Apr. 25, 2013.

* cited by examiner 3
50
1
2
9
8
2
4
7
6
5

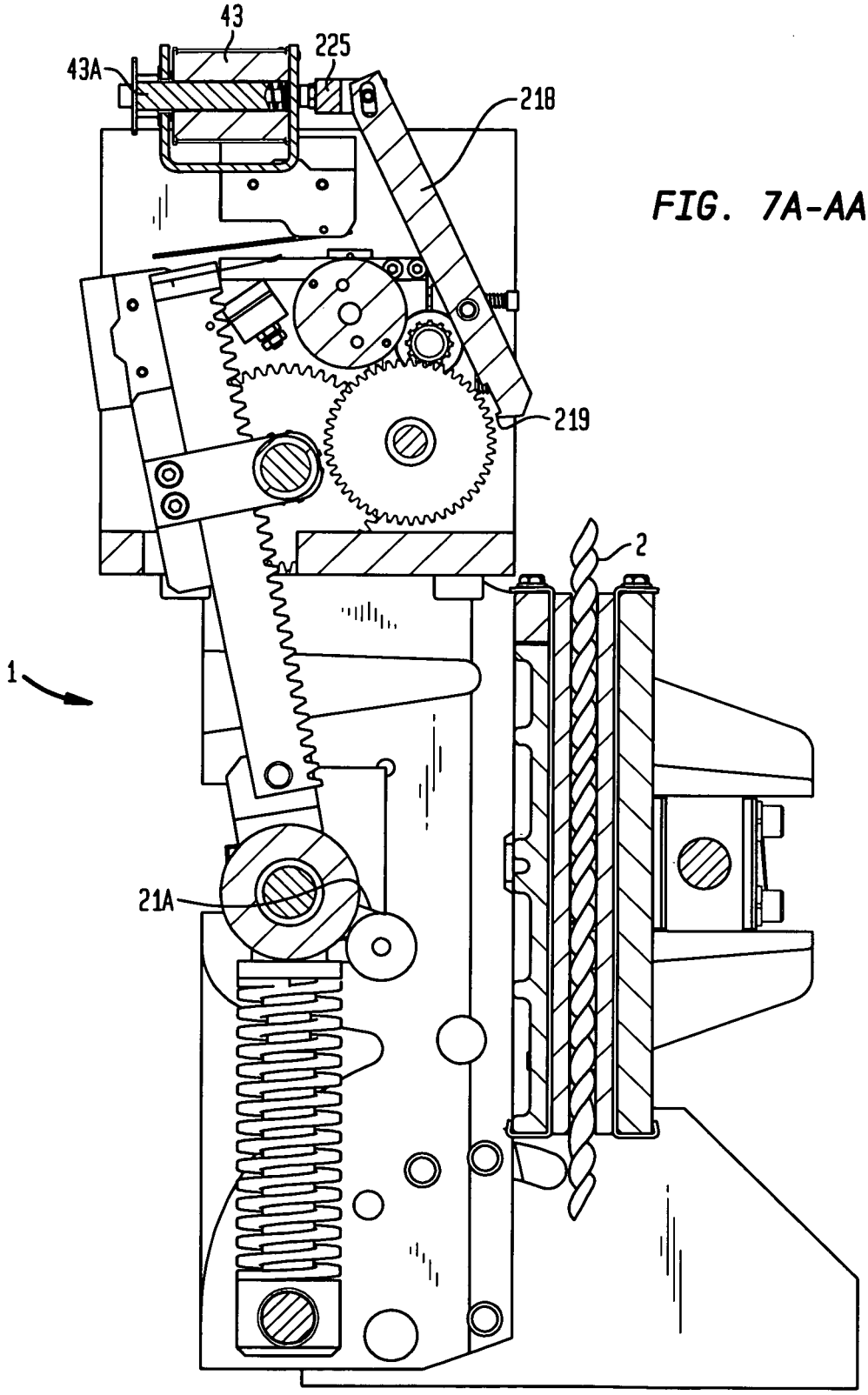
FIG. 7A-AA

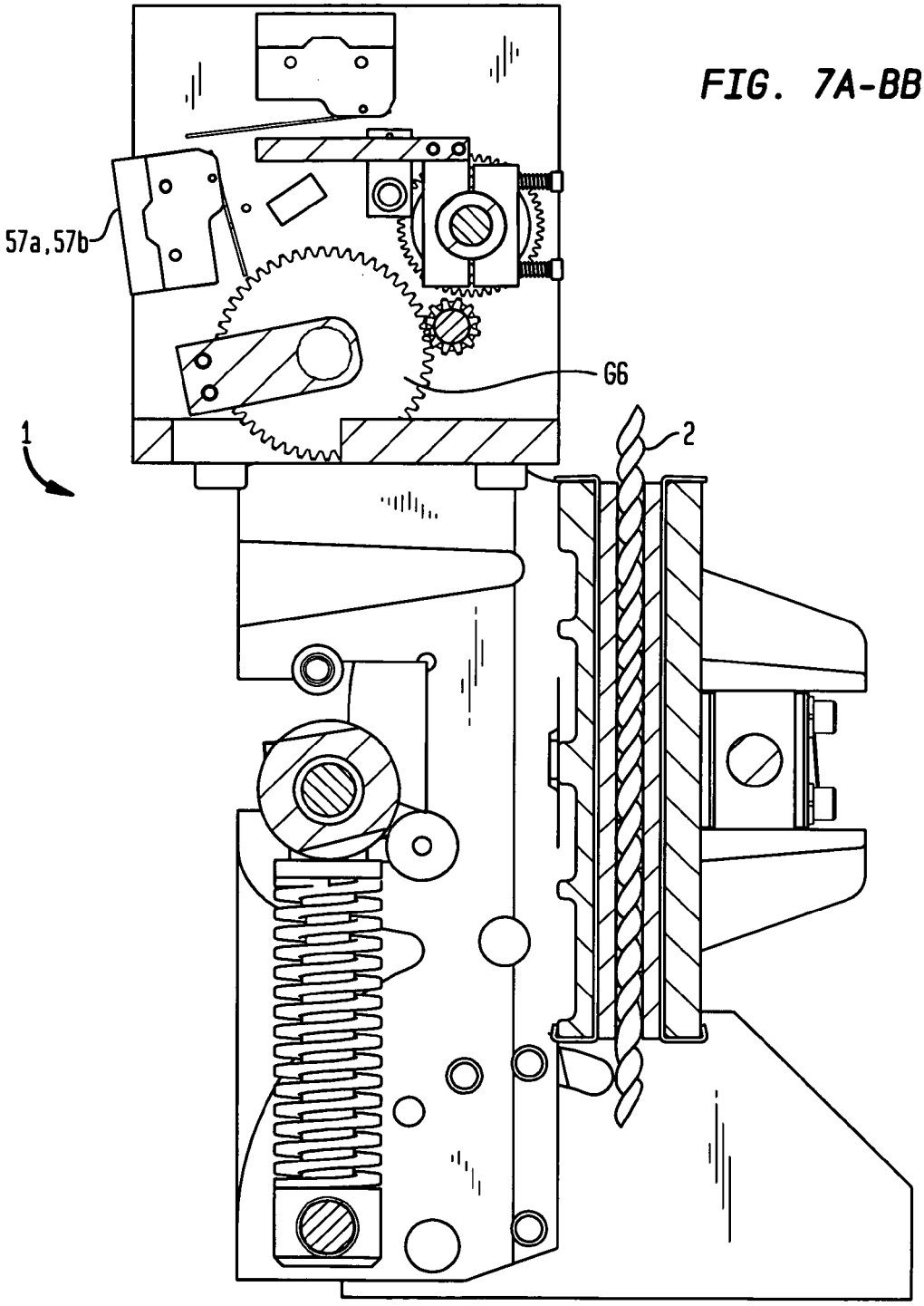
FIG. 7A-BB

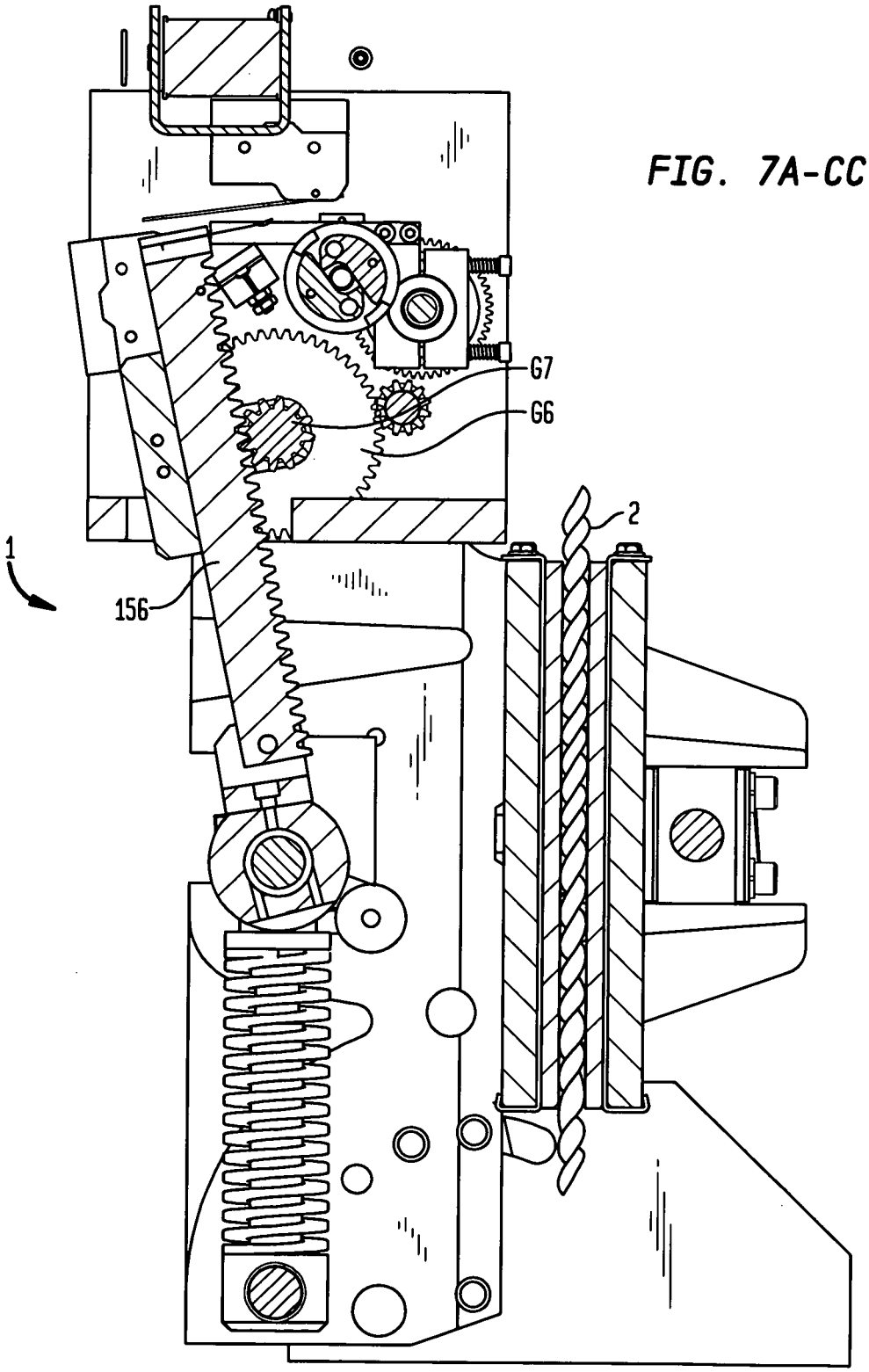
FIG. 7A-CC

FIG. 7B-AA
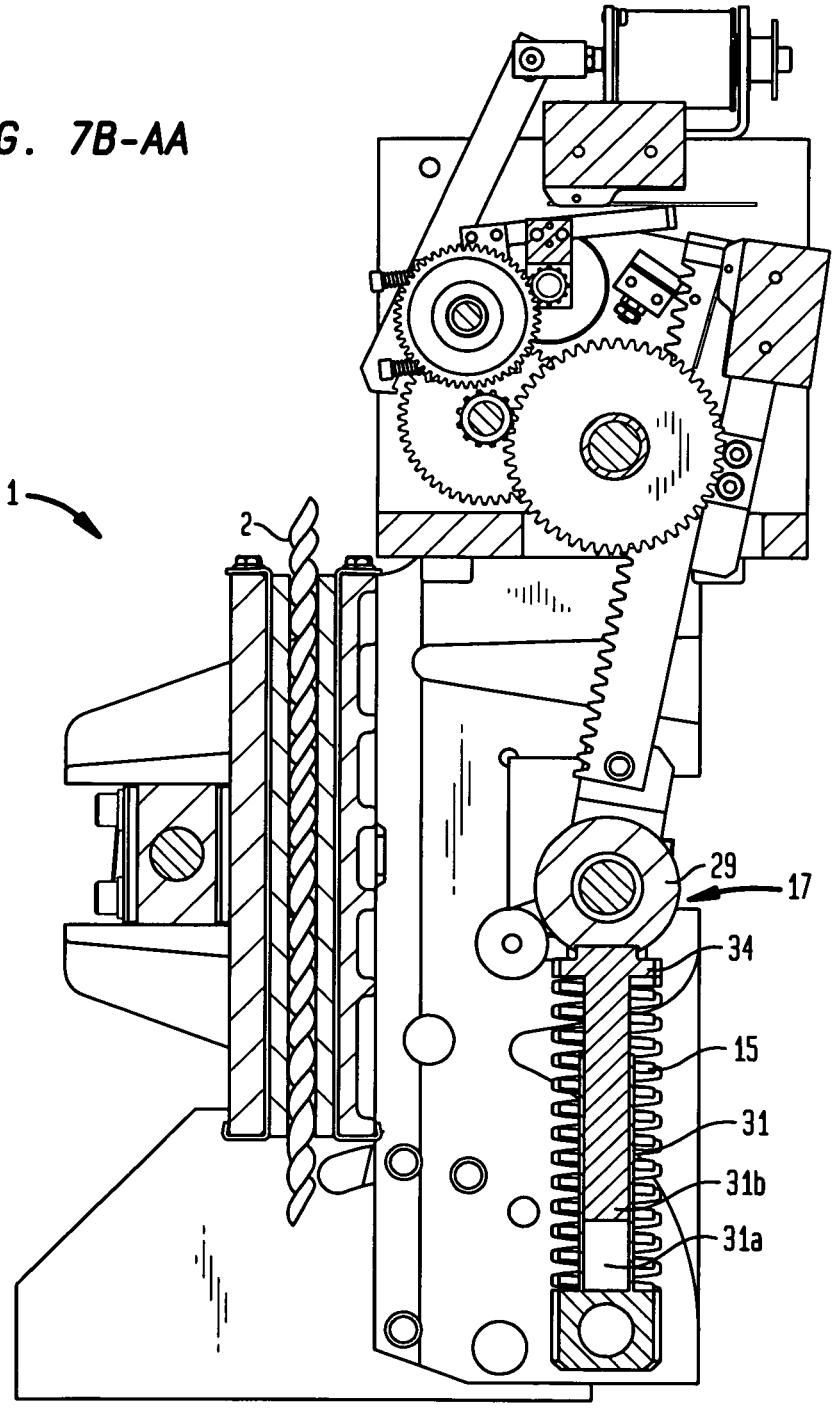

ELEVATOR CAR BRAKE WITH SHOES ACTUATED BY SPRINGS COUPLED TO GEAR DRIVE ASSEMBLY

CROSS REFERENCE TO RELATED APPLICATION

This application claims the benefit of the filing date of U.S. Provisional Patent Application No. 61/125,038 filed Apr. 21, 2008, the disclosure of which is hereby incorporated herein by reference.

FIELD OF THE INVENTION

This invention relates to an emergency brake and particularly, to an emergency brake for an elevator car. Such emergency brake can be activated by an unsafe condition, such as overspeeding of the elevator car or an elevator car leaving a floor with its door open.

BACKGROUND OF THE INVENTION

Elevator cars and other vehicles and devices, such as hooks, buckets and material harnesses on cranes or launching apparatus, are movable in two opposite directions, frequently by means of a cable or wire rope.

Generally speaking, elevator cars movable by hoist ropes are suspended by wire ropes which go over a traction sheave and down to a counterweight. The counterweight serves to reduce the power required to move the elevator, and also to create traction (prevent slippage) with respect to the traction sheave. The traction sheave is driven directly by a motor or indirectly by a motor through a geared machine. A normal brake is applied to the drive to stop and/or hold the elevator at a floor.

With elevator cars, specifically, the usual elevator codes require that an emergency brake be included, such brake arresting the descent of the elevator car when it is descending at a speed in excess of a predetermined speed. A known braking device for such purpose is the safety device which grips the car guide rails even in the event of breakage of the elevator hoisting rope.

With a high factor of safety for the wire ropes, one country has recognized that these ropes never break and is allowing other emergency brakes in lieu of the safety device which grips the guide rails. Also, since counterweights are generally heavier than the elevator, with a mechanical failure, such as that of the normal brake, there is danger of the elevator overspeeding in the ascending direction. In addition, depending on the load in the elevator car and with a mechanical failure, the car could leave the floor in either direction with the doors open. Many countries require emergency devices to be activated in the event of the above, and also require ascending car overspeed protection. In addition, many countries are considering code changes to require protection against leaving the floor with the doors opened.

Known braking devices include brakes applied to the hoisting drum (traction sheave), to the hoisting ropes, or to the car or counterweight guide rails.

It is considered to be important that the braking force be substantially constant even with wear of various elements of the braking system, such as wear of the brake shoe linings.

Braking apparatus which will stop an elevator when it overspeeds in either direction is known in the art. One known overspeed or emergency braking apparatus includes brake elements applied to the hoisting (suspension) ropes by air actuated means. While such apparatus may maintain the braking pressure constant with brake shoe lining wear, the apparatus includes several elements, such as hoses, tanks and an air cylinder or air compressor, which are subject to failure which can render the braking inoperative.

Another known emergency braking apparatus includes brake elements whose release, and dampening during application, are actuated by a hydraulic means. See, for example, U.S. Pat. No. 5,228,540, incorporated by reference herein and assigned to the assignee of this application. As known and exemplified in the '540 patent, a hydraulic system for use in such braking apparatus includes a hose, a valve, an electric pump, a manual pump and an electric motor, and connections between such components. The hydraulic system ordinarily is of a relatively large size, such that the hydraulic system needs to be contained in an enclosure separate from the remainder of the braking apparatus. Consequently, when such braking apparatus is installed, the two separate assemblies of the braking apparatus and the accompanying hydraulic system need to be mounted. Therefore, prior to installation, a location and sufficient space need to be allocated for the mounting of each of the assemblies. As the hydraulic system is separate from the remainder of the braking apparatus, during installation, a hydraulic hose needs to be installed to connect the hydraulic-related components of the two separate assemblies together, and in addition electrical wires need to be installed to electrically connect the separate assemblies.

Further, it is well known that a hydraulic system contains seals, connections, piston(s), a valve, and check valves that, over time, have the potential to fail as well as to develop leaks. Also, the hydraulic system typically contains a petroleum based fluid that, if spilled, has a potential negative environmental effect.

Therefore, there exists a need for an emergency braking apparatus and method having a minimum of components for reducing its size and the potential for mechanical, electrical or hydraulic failure.

SUMMARY OF THE INVENTION

In accordance with aspects of the present invention, a braking apparatus includes springs for pressing brake shoes into engagement with ropes controlling the movement of an apparatus, such as an elevator car, and a gear drive assembly which is operable to compress the springs for setting the apparatus to a brake release position. The springs are connected to the brake shoes through a cam and connecting link arrangement which is operably coupled to the gear drive assembly. Under normal operation of the elevator car apparatus, the springs are held in a compressed state. The springs can partially decompress for application of the brake shoes to the ropes, when the braking apparatus is switched from a brake release position to obtain a brake applied position. The brake applied position is obtained within a predetermined time, such as about 0.1-0.2 seconds, from release of the springs from the compressed state.

In one embodiment, the springs can be compressed and held in the compressed state by the gear assembly. In a further embodiment, a latch means engageable with a gear of the gear assembly or the cam may hold the springs in the compressed state.

In another embodiment, the gear assembly includes clutch means for selectively disengaging from and engaging with at least one gear or axle of the gear assembly during, respectively, decompression and compression of the springs. The disengagement of the clutch means from a gear or axle of the gear assembly, during decompression of the springs from a compressed state, avoids damage to the gear and provides for quick clamping of the ropes by the brake shoes.

In another aspect of the invention, the braking apparatus includes a resilient element for accelerating movement of a brake shoe at the start of a brake application cycle. During the brake application cycle, the springs partially decompress from a compressed state. In a further embodiment, the resilient element slows movement of gears of the gear assembly, and a motor coupled to a gear of the gear assembly, near or at the end of a brake release cycle to protect the gears from damage. During the brake release cycle, the partially decompressed springs become compressed.

In a further embodiment, the braking apparatus provides that the brake shoes apply (i) a final clamping force to a clamping surface, such as the hoisting ropes, at the end of a brake application cycle; and (ii) a predetermined percentage of the final clamping force to the clamping surface, when the brake shoes initially contact the clamping surface during the brake application cycle. In alternative embodiments, the gear drive assembly, or hydraulic or pneumatic means which are not part of the gear assembly, operates to provide that the brake shoes initially apply a predetermined percentage of the final clamping force to the ropes during a brake application cycle.

In one embodiment of the braking apparatus, the gear drive assembly includes a rack and pinion assembly that couples a cam follower to the gears of the gear assembly. The braking apparatus further includes a latch that is engaged with a gear of the gear assembly, following compression of the springs. With the latch engaged with a gear of the gear assembly, movement of the cam follower is prevented and the springs are held in a compressed state. When brake application is desired, the latch is disengaged from the gear assembly. The cam follower, which is attached to the rack and rides on a pair of cam surfaces, in turn, may freely move under the force of one or more springs, to cause one brake shoe to move toward another brake shoe, and thereby clamp the ropes between shoe linings on the shoes and arrest movement of the ropes within a predetermined time from a start of a brake application cycle. The springs are compressed by interaction between the gear assembly and the rack, and after compression of the springs, the gear assembly provides that a predetermined percentage of a final clamping force is applied to the ropes, when the brake shoes initially contact the ropes during the brake application cycle.

BRIEF DESCRIPTION OF THE DRAWINGS

Other objects and advantages of the present invention will be apparent from the following detailed description of the present preferred embodiments, which description should be considered in conjunction with the accompanying drawings in which like reference indicate similar elements and in which:

FIGS. 7A-AA, 7A-BB and 7A-CC are side elevation, cross-sectional views of the apparatus shown in FIG. 7A at cross-sectional lines 7AA-7AA, 7AB-7AB and 7AC-7AC, respectively.

FIG. 7B-AA is a side elevation, cross-sectional view of the apparatus shown in FIG. 7B at cross-sectional line 7BA-7BA.

DETAILED DESCRIPTION

Although the invention is described below in connection with a braking apparatus for applying a braking force to hoisting ropes of an elevator car, it will be apparent to those skilled in the art that the braking apparatus may have other applications, for example, to guide rails, or to other translatable equipment, such as a traction sheave, a combination of a traction sheave and ropes, a deflector sheave, a combination of a deflector sheave and ropes, or compensation ropes of an elevator car, etc.

Figure 1:
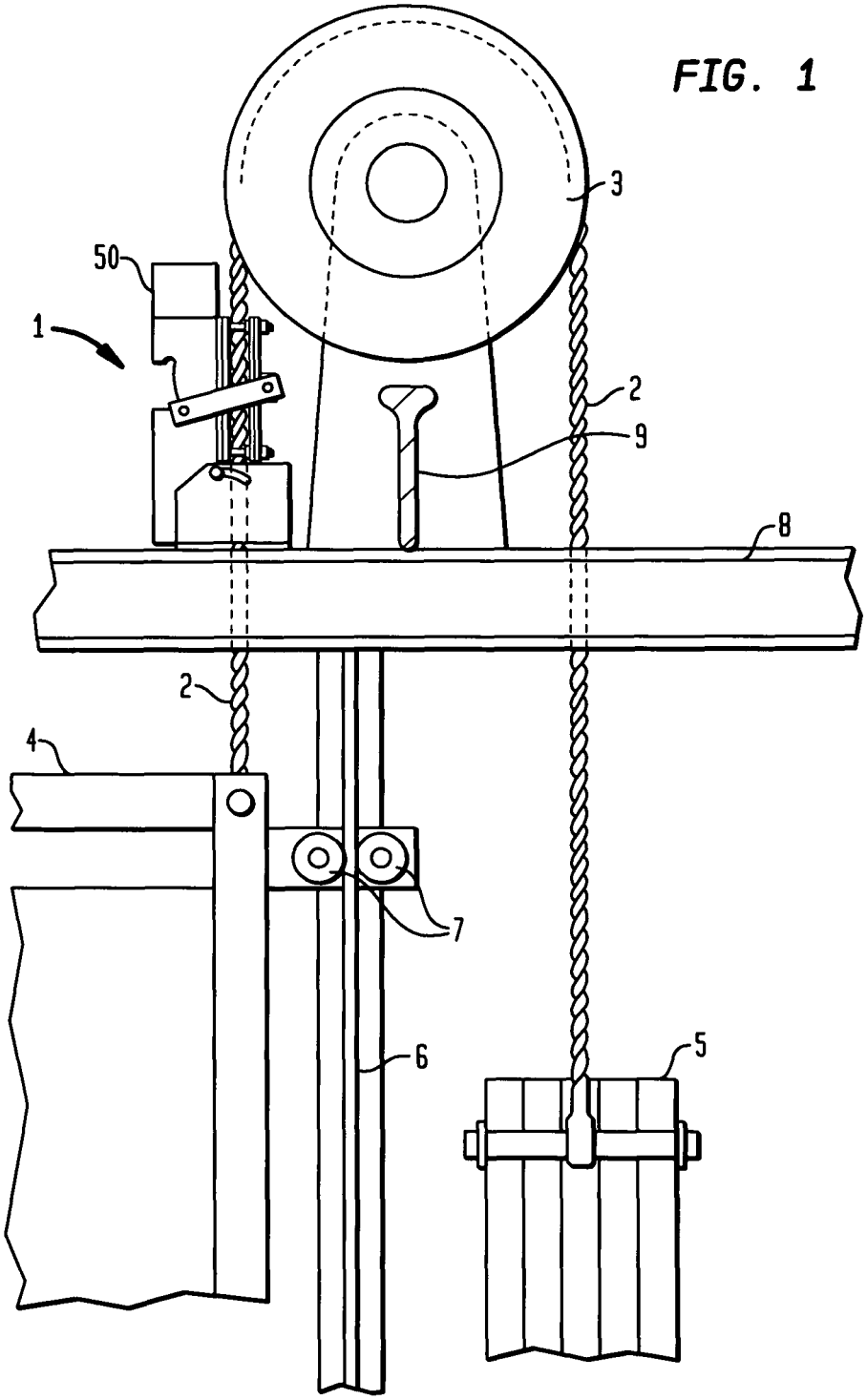
FIG. 1 is a schematic, side elevation view of the application of an apparatus in accordance with the present invention to an elevator system.

FIG. 1 illustrates schematically, in side elevation, an elevator system comprising an exemplary braking apparatus 1, in accordance with aspects of the present invention, associated with hoisting ropes 2 which pass over a motor driven traction sheave 3. The ropes 2 suspend and hoist an elevator car 4 at one side of the sheave 3, and, at the opposite side of the sheave 3, are attached to a counterweight 5. The car 4 is guided at opposite sides by guide rails and rollers, only one combination of which, rail 6 and rollers 7, is shown. The sheave 3 and its supporting apparatus are supported by fixed beams 8 and 9, and the braking apparatus 1 is supported by the beam 8, although it may be otherwise located on a fixed support.

Except for the braking apparatus 1, the equipment described in the preceding paragraph is conventional. The braking apparatus is in a fixed position and engages the ropes 2 at the side of the sheave 3 at which the rope or ropes 2 extend to the car 4, or may engage the rope or ropes at the side of the sheave 3 which extend to the counterweight 5. Also, the shoes (hereinafter described) of the braking apparatus 1 may be applied to braking of the sheave 3 in the same manner as the conventional sheave braking apparatus (not shown), or may be carried by the car 4 and applied to the guide rail 6, or if two of the braking apparatuses 1 are carried by the car 4, to the guide rail 6 and the opposite, corresponding guide rail (not shown). In all cases, relative movement between the braking apparatus and another member is arrested when the braking apparatus is actuated.

Figure 2A:
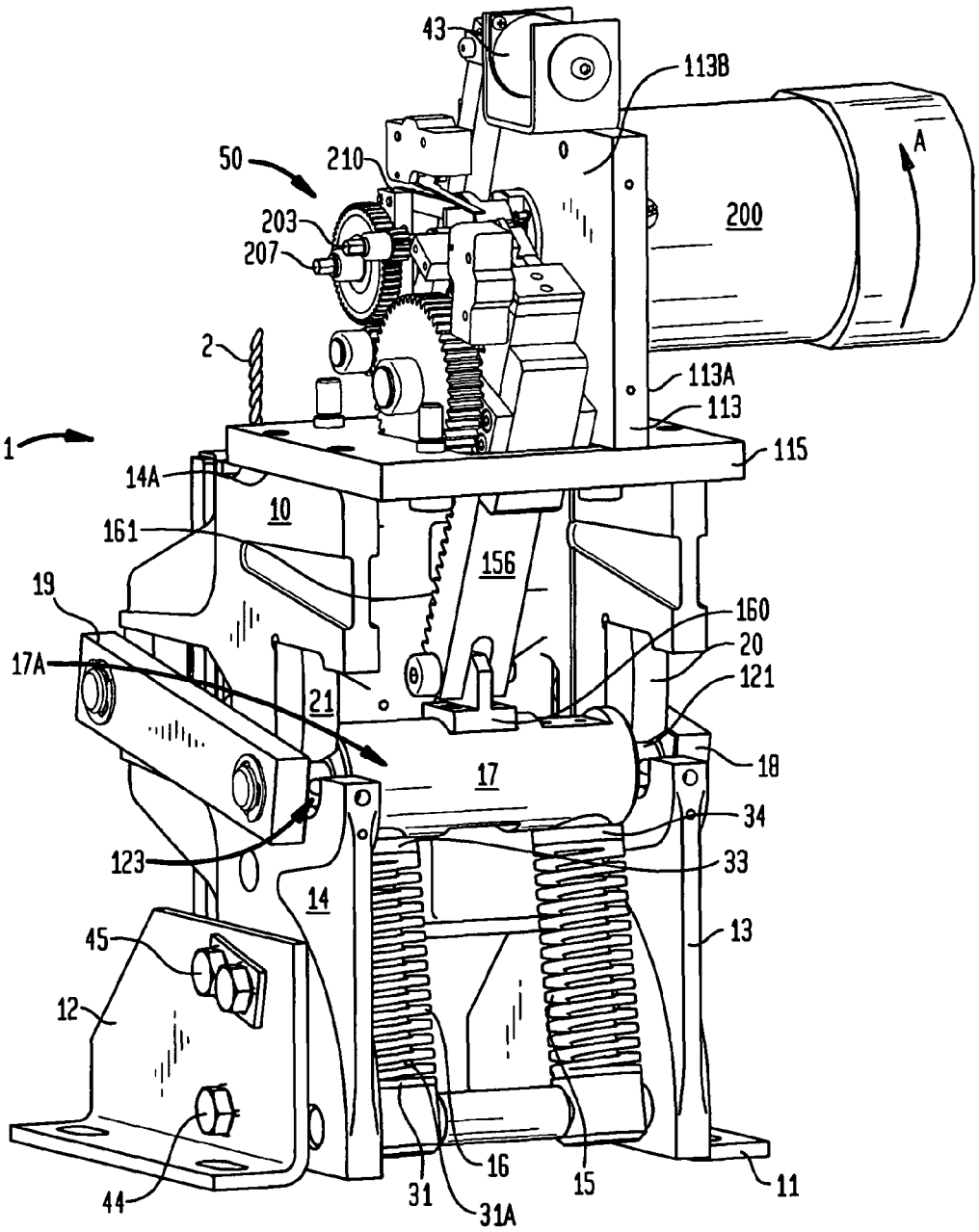
FIG. 2A is a perspective view of a portion of an exemplary apparatus, in accordance with an aspect of the present invention.
Figure 2B:
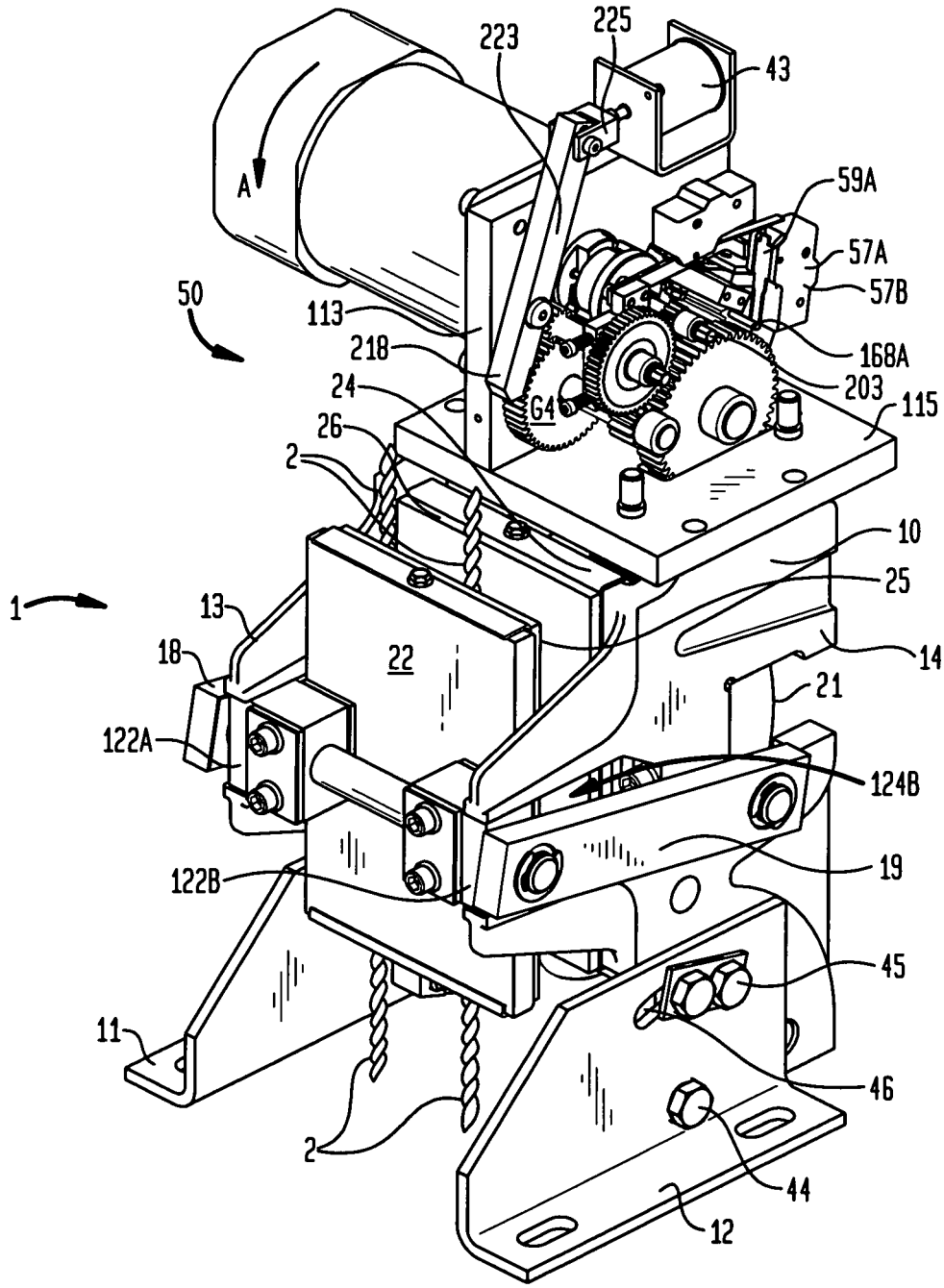
FIG. 2B is a perspective view of another portion of the apparatus shown in FIG. 2A.

The exemplary braking apparatus 1 is described in greater detail with reference to FIGS. 2-11. Referring to FIGS. 1, 2A and 2B, the braking apparatus 1 includes a metal member 10 having a pair of walls 13 and 14 securable to the beam 8 or other surface by a pair of metal angle members 11 and 12. Between the walls 13 and 14 of the member 10, there are a pair of resilient elements 15 and 16, such as compressible springs, which apply pressure to a cam means. The cam means comprises a cam follower 17. The cam follower 17 is pivotably carried by a pair of metal links 18 and 19. Also referring to FIGS. 3A, 3E and 9A, the cam follower 17 includes an inner shaft 30 which is rotatable with respect to an outer portion 29 which encircles the inner shaft 30. The shaft 30 engages a pair of cam surfaces 20 and 21 which are attached to or are a part of the walls 13 and 14, respectively.

Further referring to FIGS. 3C, 3E, 6A and 9A, the walls 13 and 14 define slots 121, 123 with ends 125, 127, respectively. The slots 121, 123 are sized slightly larger than the outer diameter of the shaft 30, so as to allow movement of the shaft 30 within the slots 121, 123 toward and away from the ends 125, 127. When the shaft 30 is within the slots 121, 123, the shaft 30 is in contact with cam surface portions 20A and 21A.

Figure 3:
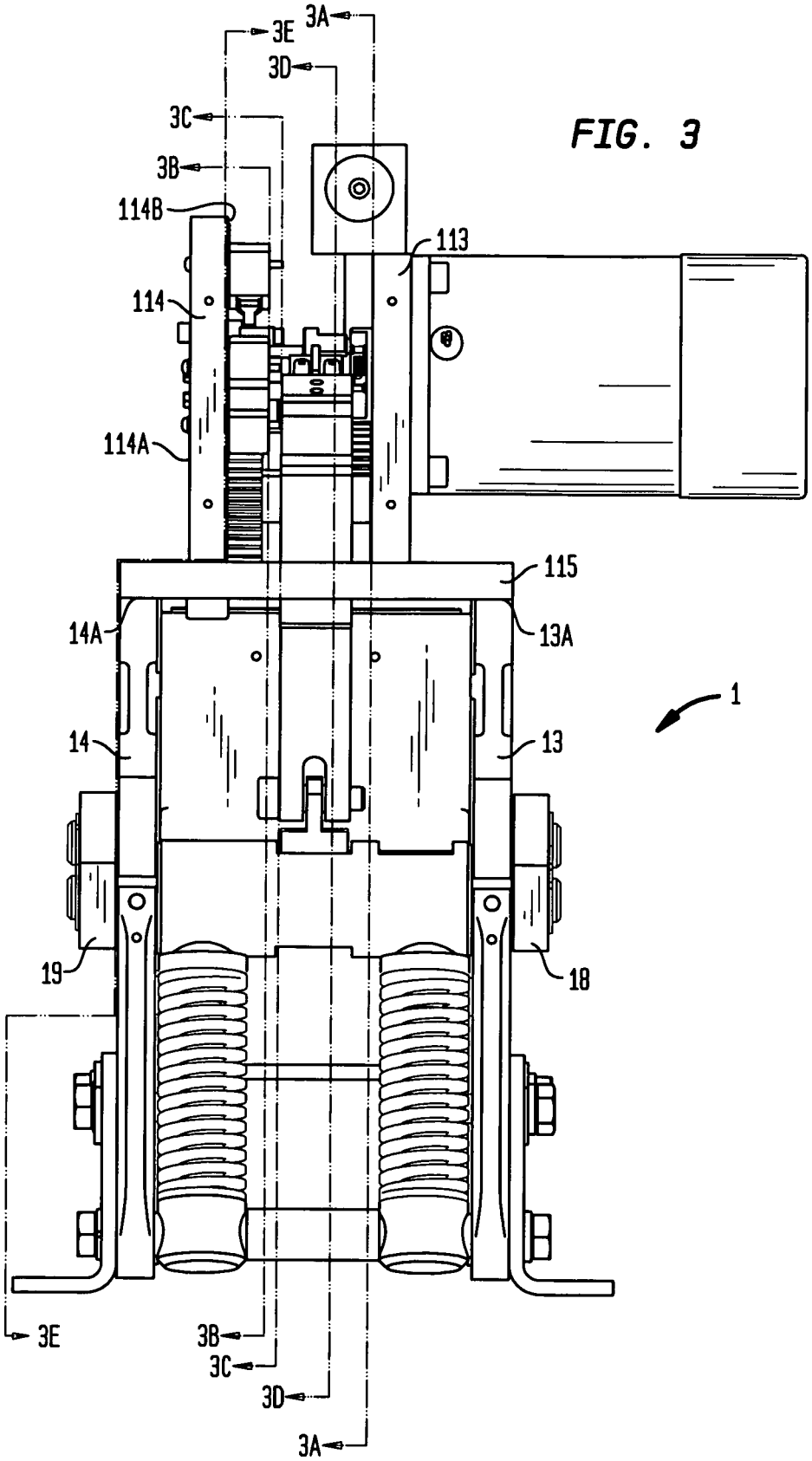
FIG. 3 is an elevation view of a portion of the apparatus shown in FIG. 2A with the parts in the brake release position.
Figure 3A:
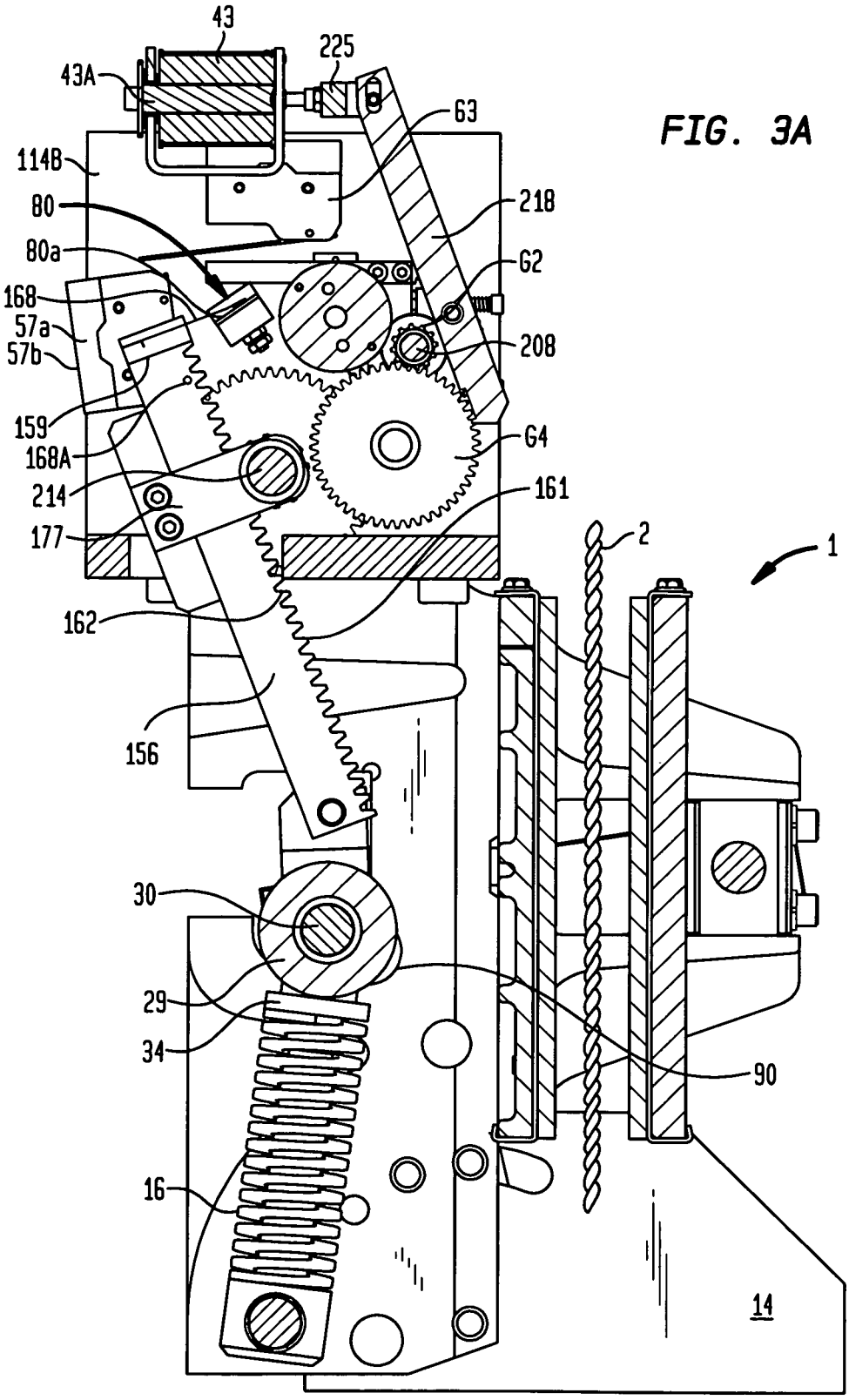
FIGS. 3A, 3B, 3C, 3D and 3E are side elevation, cross-sectional views of the apparatus shown in FIG. 3 at cross-sectional lines 3A-3A, 3B-3B, 3C-3C, 3D-3D and 3E-3E, respectively.
Figure 3B:
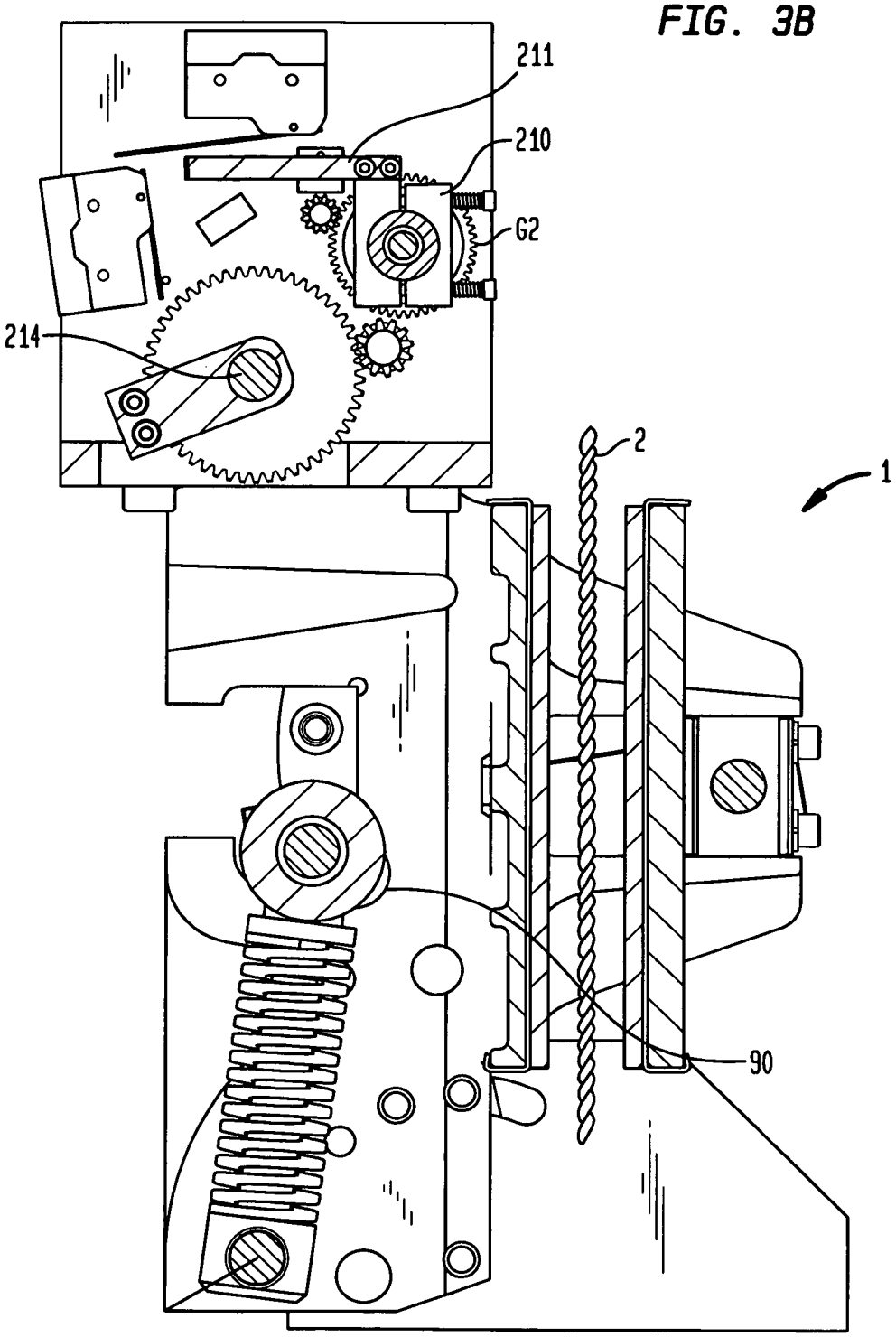
Figure 3C:
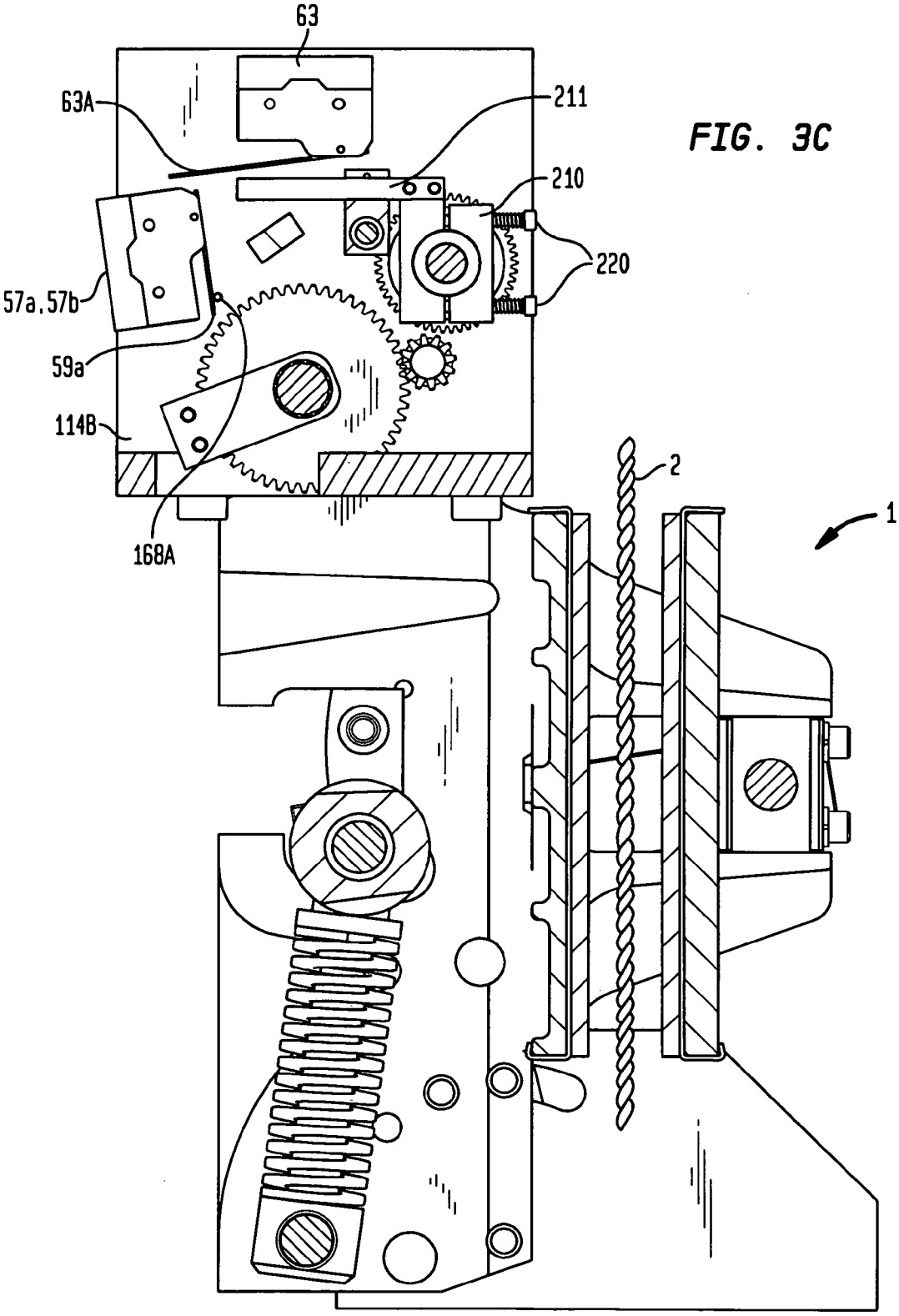
Figure 3D:
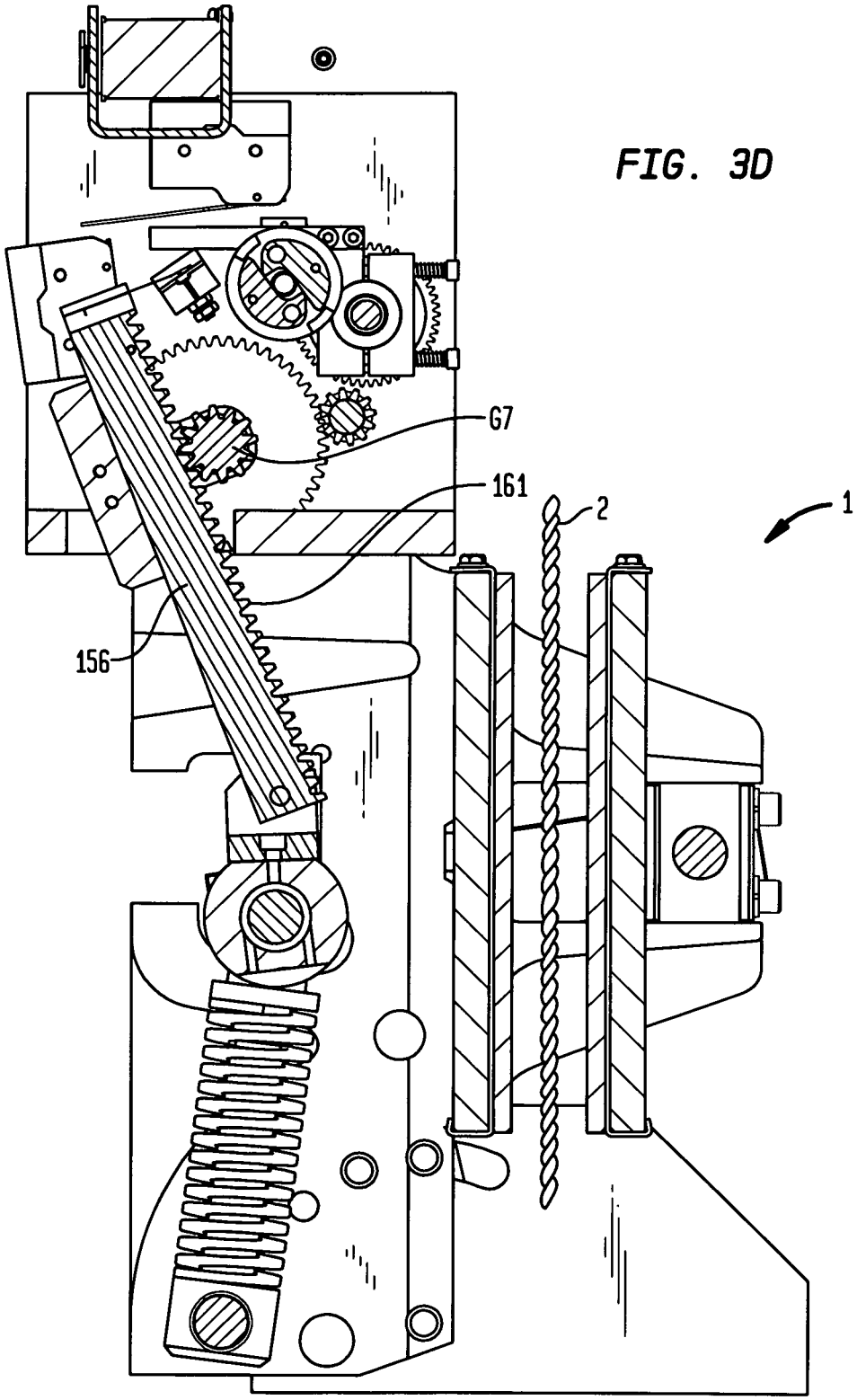
Figure 3E:
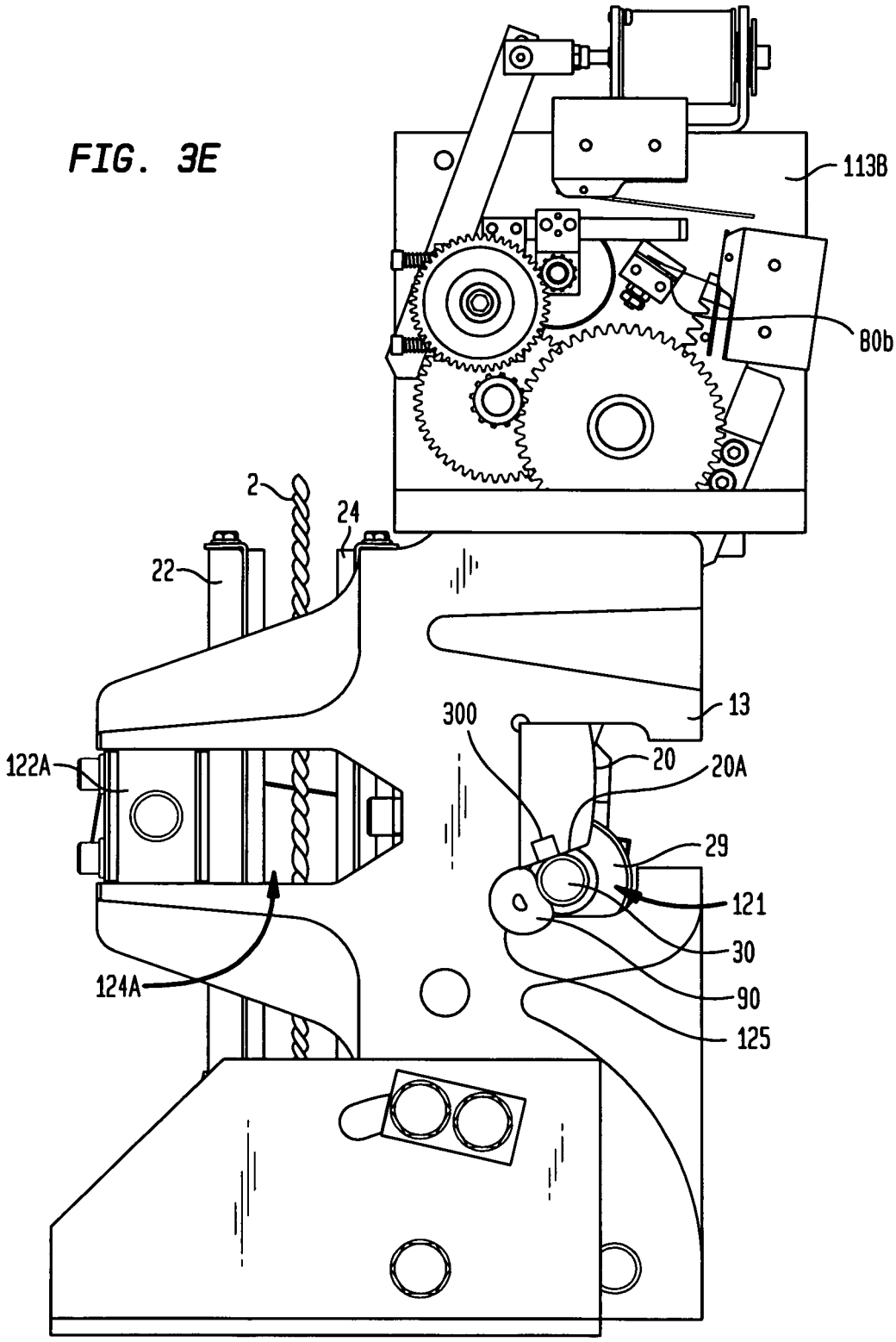

Referring to FIGS. 2A, 2B and 3E, the ends of the links 18 and 19 opposite the cam follower 17 are pivotally connected to blocks 122A and 122B affixed to a metal brake shoe 22. The blocks 122A, 122B are contained in recesses 124A, 124B formed in the walls 13, 14, respectively, and are slidable within the recesses 124A, 124B. The shoe 22, based on movement of the blocks 122 within the recesses 124, is urged away from and towards a fixed metal brake shoe 24. The shoe 24 is secured between the walls 13 and 14 in any conventional manner. The shoes 22 and 24 have conventional brake linings 25 and 26, respectively, which can, for example, be a rigid, molded, asbestos free lining of the type sold by Raymark Industrial Division, 123 East Stiegel St., Mankum, Pa. 17545 under the type No. M-9723.

It will be apparent that when the shoe 22 is moved toward the shoe 24 by a sufficient distance, the linings 25 and 26 will engage the ropes 2. In addition, when sufficient pressure is applied to the ropes 2 by the linings 25 and 26, movement of the ropes 2 relative to the shoes 22 and 24 will be arrested. The apparatus 1 of the invention can develop such pressure with the springs 15 and 16, which exert a decreasing force as the follower 17 moves upwardly. The pressure applied to the ropes 2 can be a multiple of the forces provided by the springs 15, 16. In addition, such applied pressure can be held constant, as discussed below. Also, although two springs 15 and 16 are illustrated, a single spring or more than two springs may be used for exerting a force on the follower 17.

Figure 7A:
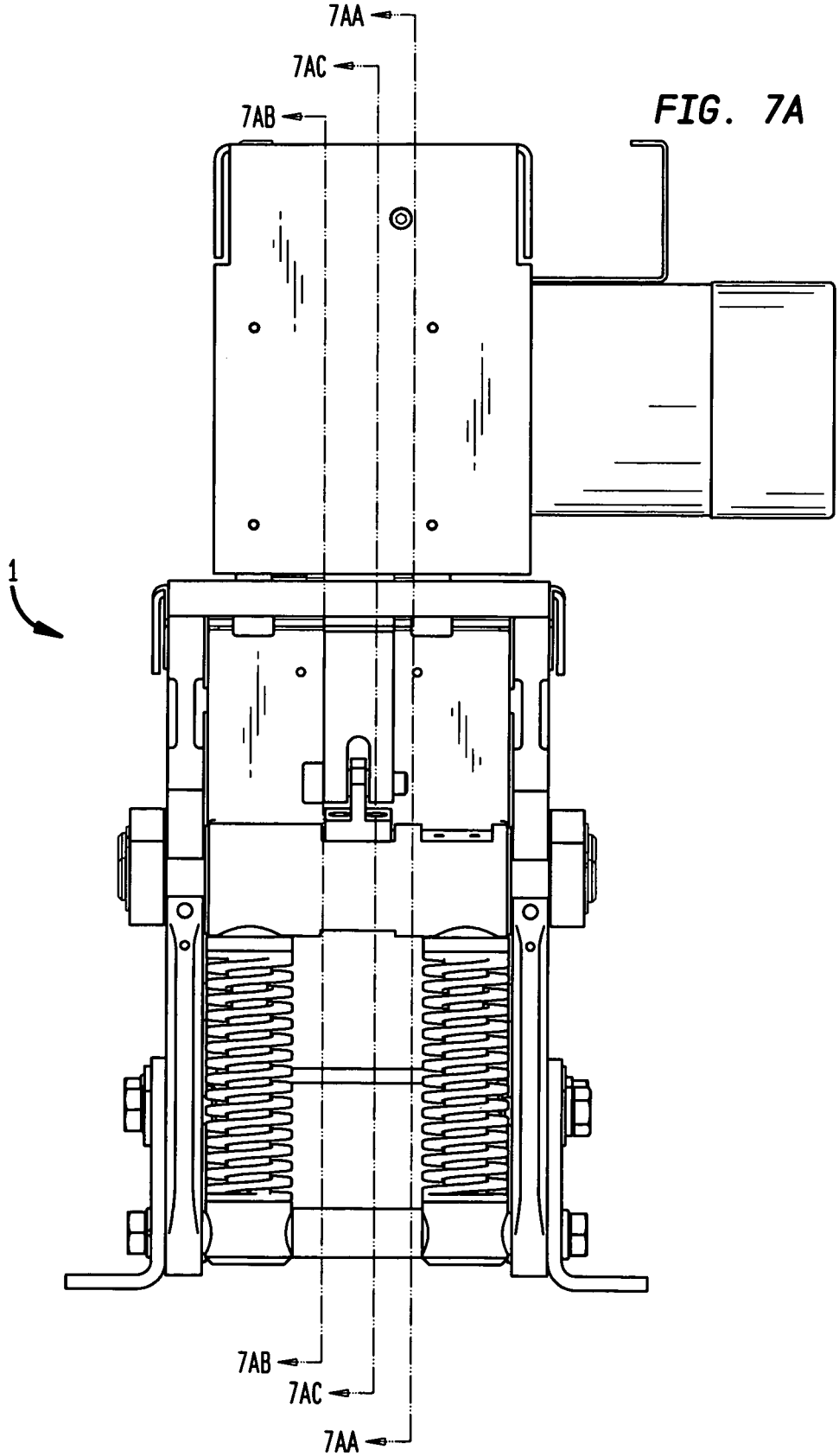
FIG. 7A is an elevation view of a portion of the apparatus shown in FIG. 2A with the parts in the brake applied position with some wear of the brake shoe linings.
Figure 7B:
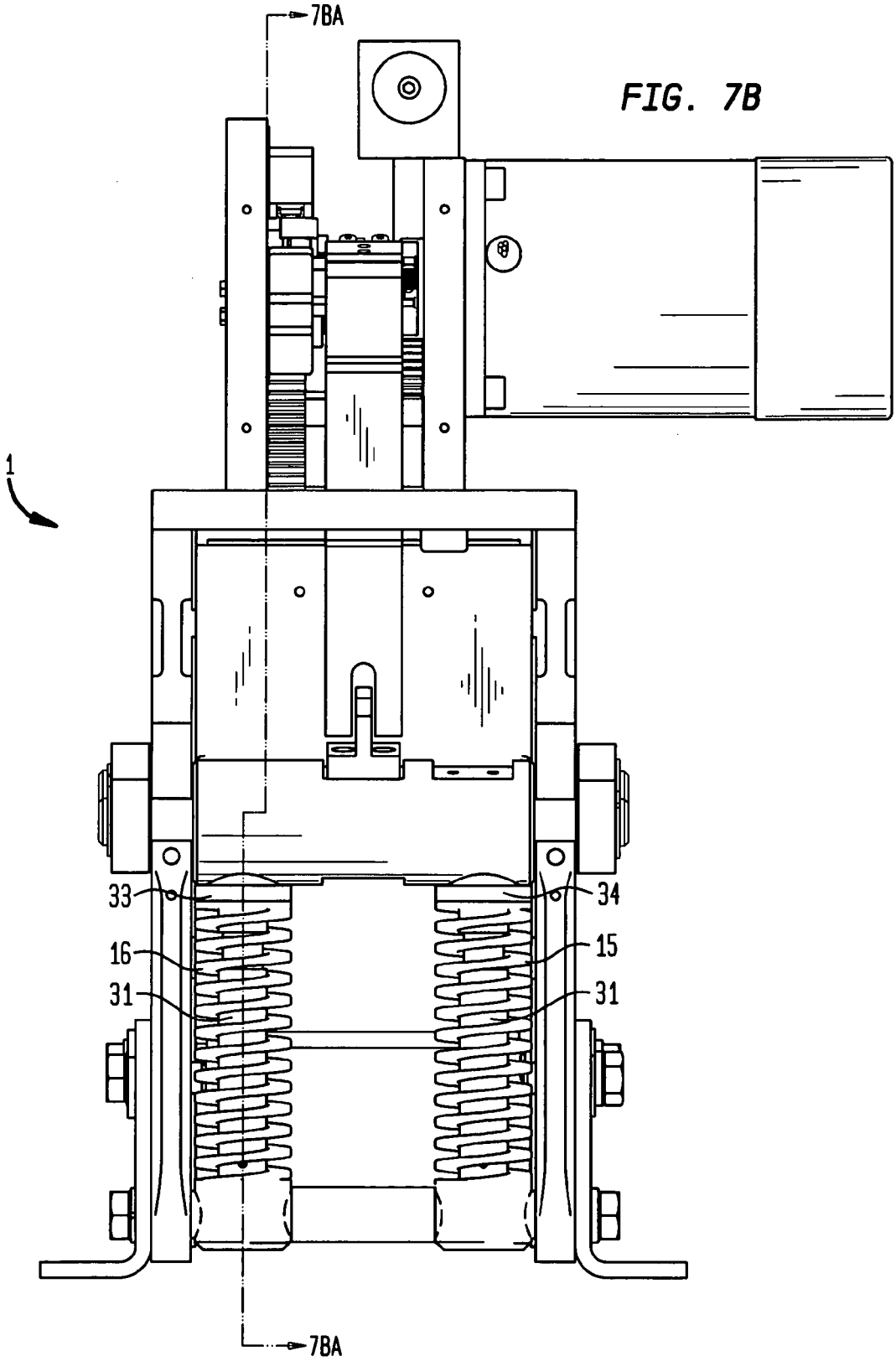
FIG. 7B is an elevation view of a portion of the apparatus shown in FIG. 2A with the parts in the brake applied position with little wear of the brake shoe linings.

Referring to FIGS. 2A, 7B and 7B-AA, the springs 15 and 16 are mounted on guides 31 which are pivotally mounted at their lower ends. As shown in FIG. 7B-AA, each of the guides 31 includes a tube 31*a* held in a position which is fixed relative to its axis and a rod 31*b* which slidably telescopes within the tube 31*a*. The upper end of the rod 31*b* is secured to the follower portion 29. The upper ends of the springs 15 and 16 have caps 33 and 34, respectively, which are shaped to engage and hold against the follower portion 29 as it moves. Alternatively, the upper ends of the springs 15, 16 may be fastened to the follower portion 29 in any desired manner.

Figure 8:
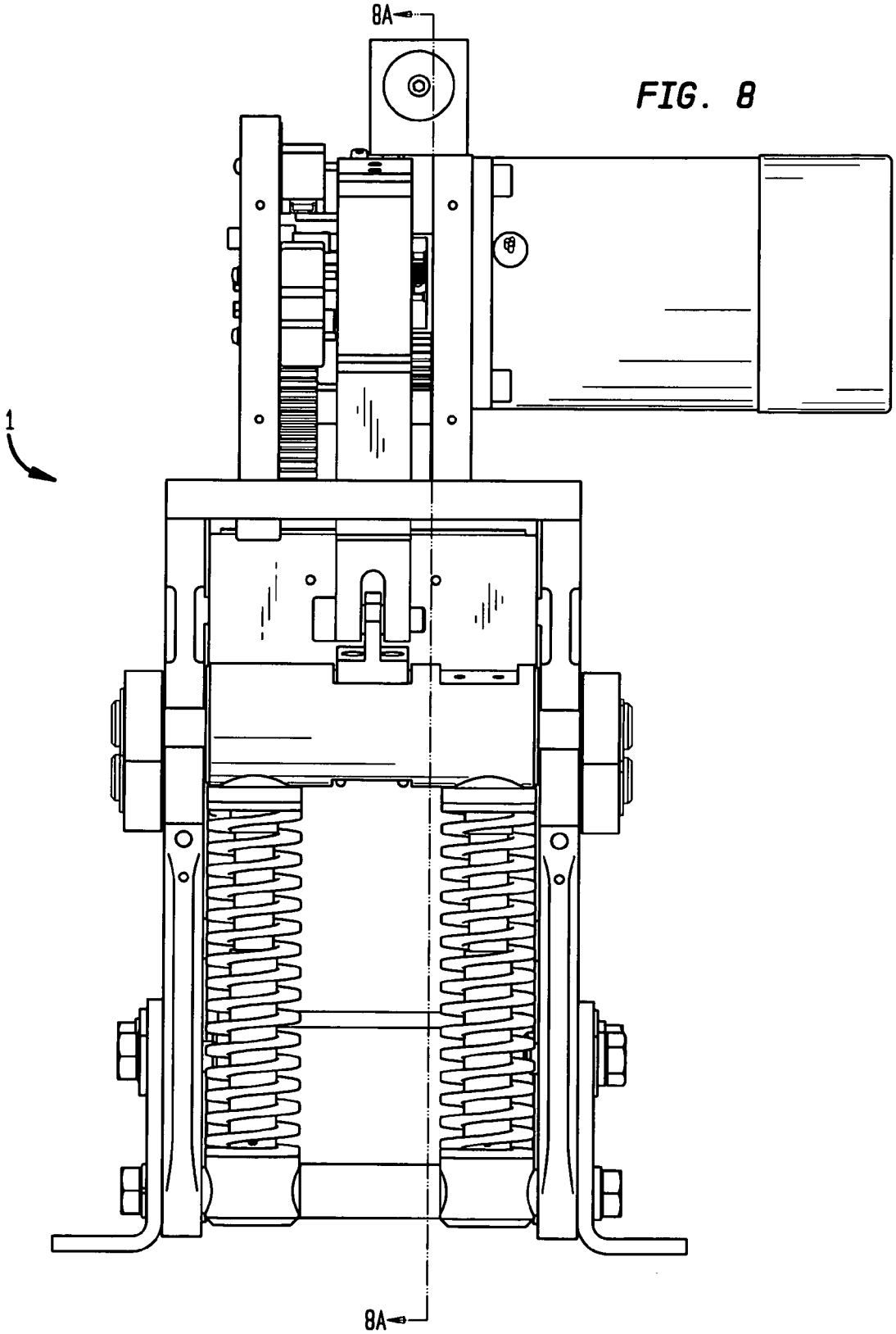
FIG. 8 is an elevation view of a portion of the apparatus shown in FIG. 2A with the parts in the brake applied position with substantial wear of the brake shoe linings.

The springs 15 and 16 are held compressed during normal operation of the elevator car, at which condition the braking apparatus 1 is in a brake release position. The braking apparatus 1 can be switched from the brake release position, such as shown in FIG. 3, to obtain a brake applied position, such as shown in FIGS. 7-8, under abnormal conditions, such as overspeeding of the car, or departure of the car from a floor with its door(s) open. When the apparatus 1 is switched from the brake release position to obtain the brake applied position, a brake application cycle occurs.

During a brake application cycle, the springs 15 and 16 are released from a compressed state, and partially decompress from the compressed state to a partially decompressed state, such as shown in FIGS. 7-8. As the springs 15, 16 decompress from the compressed state, the follower 17 is caused to move upwardly. The cam surfaces 20 and 21 are shaped, as indicated in the drawings, so that the spacing of the surfaces 20, 21 from the shoe 24 increases in the upward direction. Accordingly, as the follower 17 moves upwardly, following the cam surfaces 20 and 21, the follower 17, by way of the links 18 and 19, pulls the shoe 22 toward the shoe 24 causing the linings 25 and 26 to grip the ropes 2. At the end of the brake application cycle, the apparatus 1 is in the brake applied position and the brake shoes 22, 24 apply a final clamping force to the ropes 2. As the braking linings 25, 26 wear, the springs 15, 16 lengthen, but the cam means is designed to increase the mechanical advantage, thereby providing a powerful, constant clamping force. In one typical application of the apparatus 1, 500 pound-force springs 15, 16 are used to provide that the brake shoes apply a constant 5000 pound final clamping force to the ropes at the end of the brake application cycle.

In one embodiment, the slots 121, 123 and the cam surface portions 20A, 21A are of sufficient length to provide that, when the apparatus 1 is in the brake release position, the brake shoes 22, 24 are sufficiently spaced from each other such that the linings 25, 26 do not contact the ropes 2, even if the ropes 2 are not linearly aligned with one another.

In accordance with aspects of the present invention, referring to FIGS. 2A, 2B, 2C and 2D, the braking apparatus 1 includes a gear drive assembly 50 coupled to the cam follower 17 and operable for setting the braking apparatus 1 to a brake release position, such as shown in FIG. 3. As discussed below, during a brake release cycle, the gear assembly 50 causes the cam follower 17 to move downward to a position where the springs 15 and 16 are compressed. In addition, the gear assembly 50 is adapted to provide that, upon release of the springs 15, 16 from a compressed state, a brake applied position, such as shown in FIGS. 7-8, may be obtained within a predetermined time from commencement of a brake application cycle. Further, the gear assembly 50 is adapted to provide that a predetermined percentage of a final clamping force is initially applied by the brake shoes to a clamping surface of a clamped element, such as the hoisting ropes 2, to avoid damaging the clamped element.

Referring to FIGS. 2A, 2B, 2D, 3 and 4, the gear assembly 50 is disposed between upper walls 113 and 114. The walls 113 and 114 extend from a platform 115 mounted to upper surfaces 13A and 14A of the walls 13 and 14, respectively. The gear assembly 50 may include gears G1-G7. Gear G1 is secured to an axle 202 which extends away from inner wall surface 113B of the upper wall 113 and terminates at a hex-shaped end 203. Gear G2 is engaged with gear G1, and is selectively engaged with and disengaged from an axle 206 by an overrun clutch 208. The clutch 208, as further described below, protects the gears G1 and G2 from becoming damaged near the end of a brake application cycle. The gears G1 and G2 constitute a first gear set.

The axle 206 extends from a hex-shaped end 207 to an end 209 rotatably received within an aperture (not shown) of the wall 113. The axle 206 further includes a gear G3 proximate the surface 113B and engaged to a gear G4 secured to an axle 212. The gears G3 and G4 constitute a second gear set of the assembly 50. The axle 212 includes an end 213 rotatably received within an aperture (not shown) of the wall 113B. The gear G5 is secured to the axle 212 at the end opposite the end 213. Also, the gear G5 is engaged with the gear G6 on an axle 214. The axle 214 is received within and extends from an aperture (not shown) in the interior surface 113B of the wall 113, such that the axle 214 can rotate freely. The gears G5 and G6 constitute a third gear set of the assembly 50. The gear G7 is disposed on the axle 214 intermediate the gear G6 and the surface 113B.

Referring to FIGS. 2A, 2B, 2D, 3A and 4, the gear assembly 50 includes a rack 156 having a lower end 157, an upper end 159, a surface 167 extending between the lower and upper ends 157, 159 and facing the wall 114, and a surface 162 extending between the lower and upper ends 157, 159 and transverse to the walls 113 and 114. The surface 162 includes protruding teeth 161 extending intermediate the lower and upper ends 157, 159. The lower end 157 of the rack 156 includes legs 155*a* and 155*b* spaced apart from each other and respectively including apertures (not shown) aligned with each other. A mounting plate 160 is rigidly affixed to outer surface 17A of the cam follower 17. The plate 160 includes an aperture (not shown) sized to correspond to the size of the apertures in the legs 155*a* and 155*b*. A bolt 155 with a threaded end extends through the apertures of the legs 155*a* and 155*b* and the aligned aperture of the mounting plate 160. A nut (not shown) is threaded on the threaded end of the bolt 155, such that the rack 156 is pivotally mounted to the cam follower 17 at the bolt 155. During movement of the cam follower 17 up and down along the cam surfaces 20, 21, the end 157 of the rack 156 can move toward and away from the shoe 24, and also pivot about the bolt 155, as the cam follower 17 moves toward and away the shoe 24, which causes the shoe 22 to move towards and away from the shoe 24. The springs 15, 16, and the rack 156 are operably connected with the cam follower 17 to maintain the cam follower 17 in contact with the cam surfaces 20, 21.

In another embodiment, the slots 121, 123 of the apparatus 1 may be configured to substantially follow the shape of the cam surfaces 20, 21, and confine respective portions of the shaft 30 therein, such that the slots 121, 123 themselves maintain the cam follower 17 in contact with the cam surfaces 20, 21.

Referring to FIGS. 3, 3A and 3E, the rack 156 includes an activating arm 168 extending orthogonally away from the edge 162 at the end 159. In addition, a contact element 80 including spaced contacts 80*a* and 80*b* is mounted to interior surface 114B of the upper the wall 114. The arm 168 is of sufficient length so as to contact the spaced contacts 80*a* and 80*b* of the contact element 80, when the brake apparatus 1 is held in the brake release position.

Referring to FIGS. 2A, 2D, 3A and 3D, the teeth 161 of the rack 156 are engaged to teeth of the gear G7. A mounting 177 secures the rack 156 to the axle 214 proximate the gear G7, as is conventional for a rack and pinion apparatus. The rack 156 is pivotally mounted to the cam follower 17 at the end 157. The teeth 161 of the rack 156 may move in relation to the teeth of the gear G7 when the gear G7 is driven to rotate in one direction during a brake release cycle, or in an opposite direction during a brake application cycle. When the teeth 161 of the rack 156 move in relation to the gear G7, the shaft 30 of the cam follower 17 is maintained in contact with and moves along the cam surfaces 20, 21.

Referring to FIGS. 2B, 2C, 3, 3A and 3C, a combination switch 57*a* and 57*b* including an activating arm 59A is secured to the interior surface 114B. The rack 156 includes a pin 168A adjacent to the end 159 and extending from the surface 167 toward the wall 114. The pin 168A is of sufficient length to cause the activating arm 59A of the switch 57*a* and 57*b* combination to move to a position that closes normally open switch 57*a* and opens normally closed switch 57*b*, when the springs 15, 16 are fully compressed. Further, when the springs 15, 16 begin decompressing and remain decompressed, the pin 168A, based on movement of the rack 156 upwardly, no longer contacts the activating arm 59A, such that the arm 59A moves to a position where the normally open switch 57*a* is opened and the normally closed switch 57*b* is closed.

Figure 4:
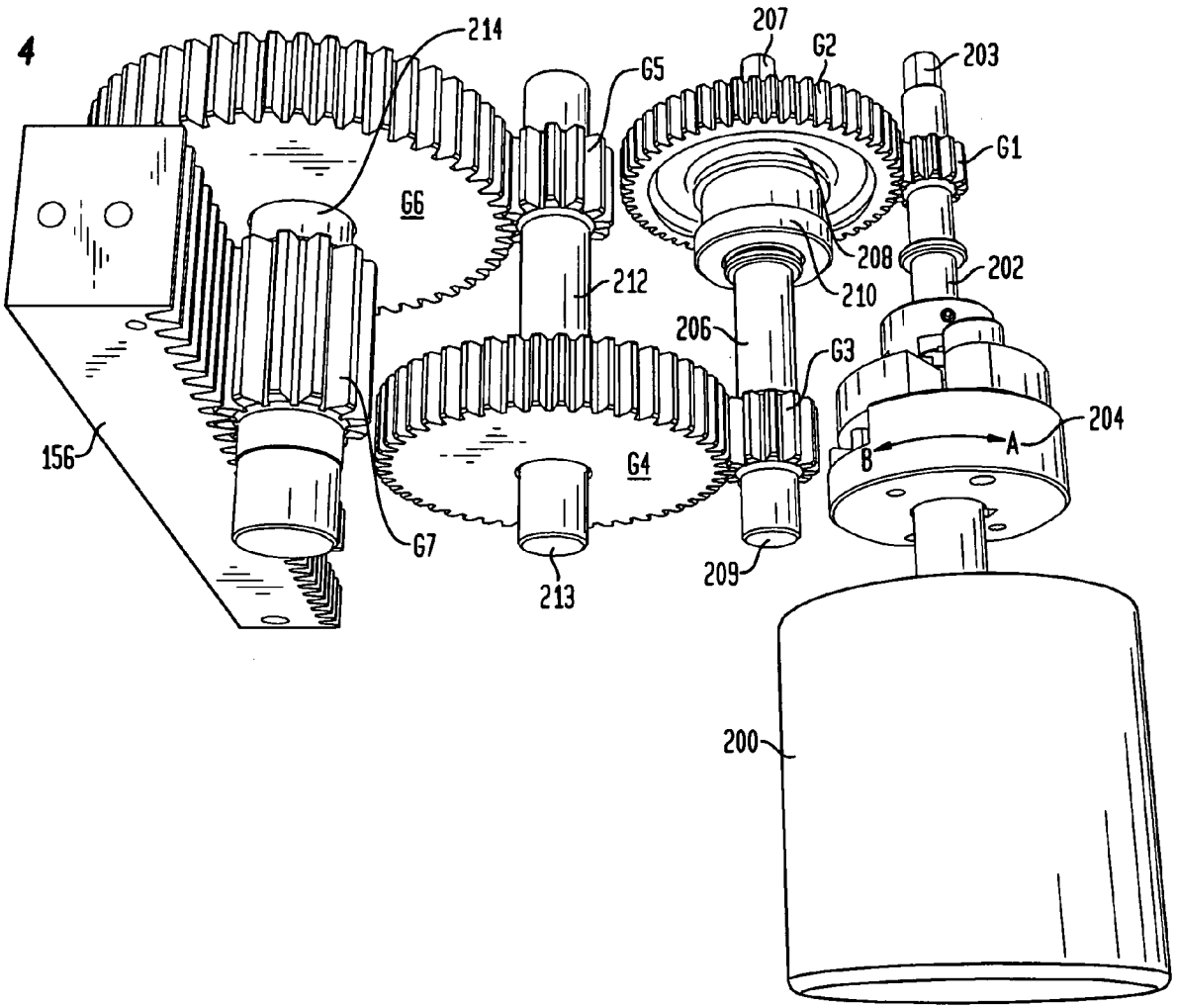
FIG. 4 is a linear, schematic view of the gears of the gear apparatus of the braking apparatus of FIG. 2A, from the perspective of the motor.

Referring to FIGS. 2A, 2B and 4, the assembly 50 is coupled to a motor 200 mounted to outer surface 113A of the wall 113. The motor 200 includes a drive axle extending through an aperture in the wall 113 (not shown) and for driving the gear G1 of the assembly 50. For purposes of explaining the operation of the assembly 50, it is assumed that, when the motor 200 operates to compress the springs 15, 16 during a brake release cycle, the axle 202, and thus the gear G1, rotate in a direction A, which causes the gear G2 to rotate in the opposite direction B, as shown in FIGS. 2B and 4.

The assembly 50 may include a centrifugal clutch 204. The clutch 204 decouples the motor 200 from the gears of the assembly 50 while the apparatus 1 is in the brake release position, and provides that the motor 200 remains decoupled from the gears during a brake application cycle. As the motor 200 is decoupled from the gears of the assembly 50 during a brake application cycle, a brake applied position may be obtained within a predetermined time, such as within about 0.1-0.2 seconds, from the commencement of a brake application cycle, as discussed below.

Referring to FIGS. 2A, 2B and 4, the centrifugal clutch 204 has an input fixedly coupled to the drive axle of the motor 200 adjacent to the surface 113B, and an output secured to the axle 202. In one embodiment, the clutch 204 includes weights or weighted arms that move radially outwardly as the speed of rotation of the drive axle in the direction A increases, and force the input of the clutch 204 to engage the output. When the speed of rotation of the drive axle in the direction A attains a predetermined value, the input and output of the clutch 204 are engaged, thereby causing the axle 202 to rotate in correspondence with the rotation of the drive axle in the direction A. Following engagement of the clutch 204 to cause the axle 202 to rotate with the axle of the motor 200 in the direction A, when the rotation in the direction A stops altogether, such as would occur once the springs 15, 16 of the apparatus 1 are fully compressed, the clutch 204 disengages such that the drive axle of the motor 200 is disengaged from the axle 202.

Referring to FIG. 4, the assembly 50 also may include the roller or overrun clutch 208. The clutch 208 operates to decouple the gears G3, G4, G5, G6 and G7 from the gears G1 and G2, near the end of a brake application cycle. The clutch 208, thus, protects the gears G1 and G2, which desirably have a smaller mass than the gears G3-G7, from becoming damaged when the rotation of the gears G3-G7 abruptly slows or stops near the end of a brake application cycle, as discussed below.

In one embodiment, the overrun clutch 208, such as sold by The Torrington Company, includes an outer race and an inner race which is formed by the addition of a shaft. The outer and inner races, in combination, operate in the form of a one way locking bearing as follows. Referring to FIG. 4, when the outer race is rotating in the direction B, or the inner race is rotating in the direction A, the races are locked together. In addition, when rotation of the inner race is causing the outer race to rotate, and the speed of rotation of the inner race begins to decrease or the inner race stops rotating altogether, the outer race may rotate freely from the inner race. Further, when the outer race is being caused to rotate in the direction A and the inner race is being caused to rotate in the direction B, the races may freely rotate in opposite directions independently of each other.

Referring again to FIG. 4, the inner race of the overrun clutch 208 is the axle 206, and operates to provide that the gear G2, which is secured to the outer race (not shown), is selectively engaged with or disengaged from the axle 206 as follows. During a brake release cycle with the gear G1 rotating in the direction A and the gear G2 rotating in the direction B, the outer race of the clutch 208 becomes locked to the inner race. When the outer and inner races are locked to each other, the axle 206 is caused to rotate in the direction B, which in turn causes the gears G3-G7 to rotate. At the start of a brake application cycle, the gear G2 and axle 206 rotate at the same speed in the direction A. Near the end of a brake application cycle, when the rotation speed of the axle 206 begins to decrease quickly to zero, the outer race of the clutch 208 becomes disengaged from the inner race, such that the gear G2 is disengaged from the axle 206 and can rotate freely in the direction A.

In a further aspect, a friction clutch 210 is coupled to a gear of the assembly 50 and provides for monitoring of whether the gear is rotating. The friction clutch 210 provides that the motor 200 becomes energized only when the monitored gear is not rotating. Referring to FIGS. 3C and 4, the friction clutch 210 may be coupled to the gear G2. Also, a normally closed switch 63 including an activating arm 63A is mounted to the surface 114B of the wall 114. The friction clutch 210 includes an activating arm 211 extending therefrom. The activating arm 211 is of sufficient length to contact the activating arm 63A of the normally closed switch 63 so as to open the switch 63 when the setting of the brake apparatus 1, which had been in a brake release position, is being switched to obtain a brake applied position. As long as the gear G2 is rotating in the direction A, which occurs during a brake application cycle, the friction clutch 210 maintains the switch 63 open, such that if power were to be applied to the apparatus 1, the motor 200 could not become energized, and thus operate.

Referring to FIGS. 2B, 2C, 3A, 6A and 7A-AA, a tip 219 at end 221 of a pawl 218 may be engaged with the gear G4. Opposite end 223 of the pawl 218 is pivotally connected to a connecting element 225. The connecting element 225 is connected to a plunger 43A of a spring driven, electrically energizable solenoid 43 mounted on a top surface 113C of the wall 113. The pawl 218 is pivotally mounted on a pin 229 fixed to the interior surface 113B of the wall 113 at an aperture 222 intermediate the ends 221, 223. When the solenoid 43 is energized, which occurs after the brake apparatus 1 has been set to the brake release position where the springs 15, 16 are fully compressed, the plunger 43A of the solenoid 43 urges the connecting element 225 away from the solenoid 43, which in turn urges the end 223 of the pawl 218 away from the solenoid 43. As the end 223 moves away from the solenoid 43, the pawl 218 rotates about the pin 229, thereby causing the tip 219 at the end 221 to move toward and engage with the gear G4. The engagement of the tip 219 with the gear G4 sets the apparatus 1 in a latched condition. When the apparatus 1 is in the latched condition, the springs 15, 16 are held in a compressed state, in other words, the brake release position is maintained.

The solenoid 43 is de-energized when the braking apparatus 1 is switched from a brake release position to obtain a brake applied position. When the solenoid 43 is de-energized, the spring within the solenoid 43 expands, pushing the plunger 43A. In turn, the end 223 moves toward the solenoid 43, which causes the pawl 218 to pivot about the pin 229 and, thus, the end 221 moves away from the gear G4, thereby disengaging the tip 219 from the gear G4. The apparatus 1 is now in an unlatched condition, where the springs 15, 16 are not held in a compressed state. The disengagement of the tip 219 from the gear G4, as discussed below, releases the follower 17 and permits the springs 15 and 16 to move the follower 17 upwardly into the positions shown in FIGS. 7 and 8.

In an alternative embodiment, the solenoid 43 does not include a spring. The solenoid 43 is mounted to the apparatus 1, such that, when the solenoid 43 is de-energized, the force of gravity may act on the plunger 43A, thereby providing that the end 233 moves toward the solenoid 43.

In a further embodiment where the solenoid 43 does not include a spring, the pawl 218 with the tip 219 is configured, such that the force applied by the springs 15, 16, through the gears of the assembly 50, is sufficient to move the tip 219 away from the gear G4 when the solenoid 43 is de-energized.

Figure 8A:
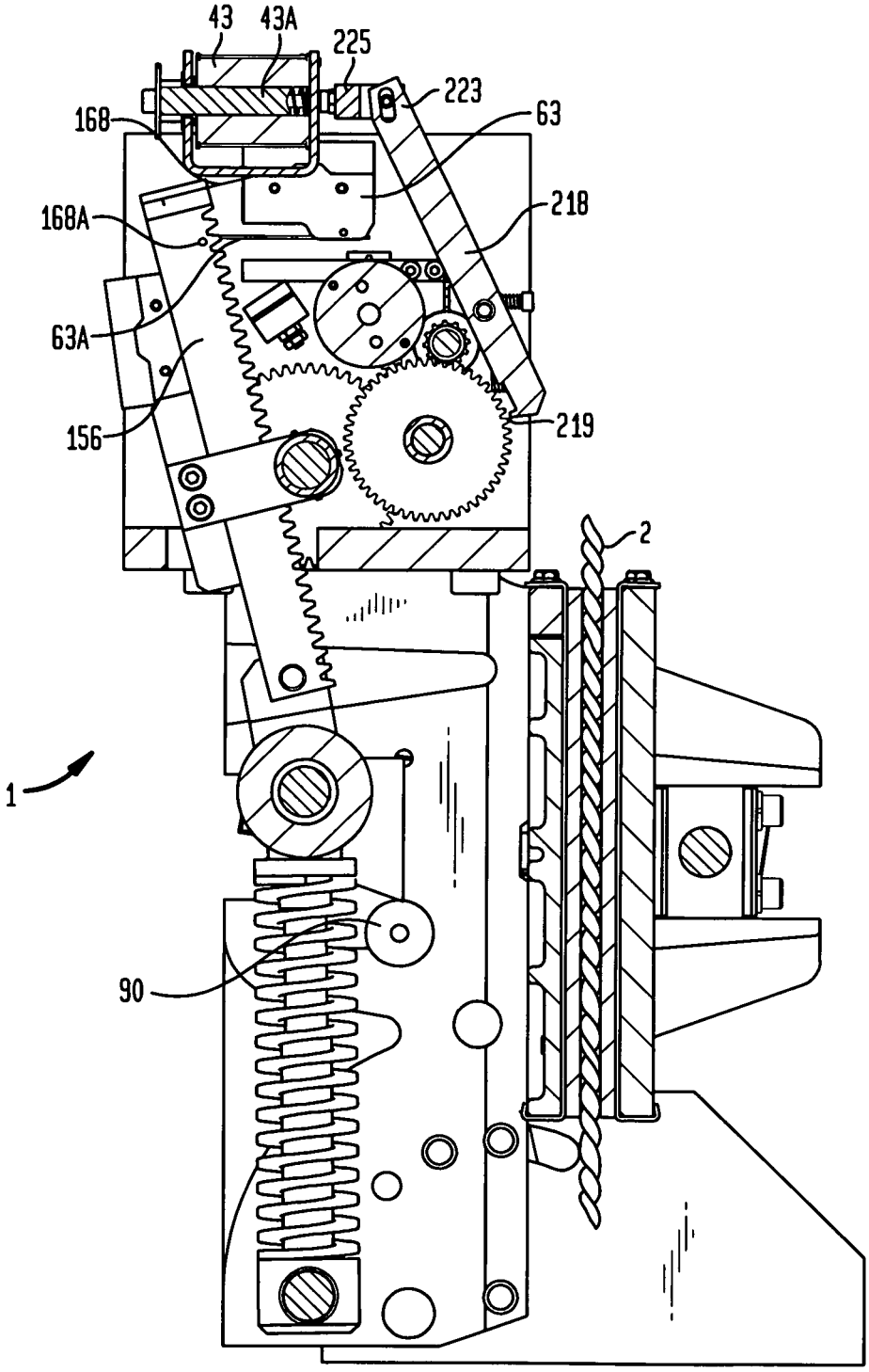
FIG. 8A is a side elevation, cross-sectional view of the apparatus shown in FIG. 8 at cross-sectional line 8A-8A.

Referring to FIGS. 8 and 8A, the pin 168A of the rack 156 is disposed in relation to the switch arm 63A of the switch 63, such that, in the event the rack 156 has moved upwardly to such an extent based on excessive wear of the shoes 22 and 24, the pin 168A contacts the activating arm 63A to open the normally closed switch 63. When the switch 63 is opened, the brake apparatus 1 remains in the applied position, even if power to the apparatus 1 is restored.

Figure 10:
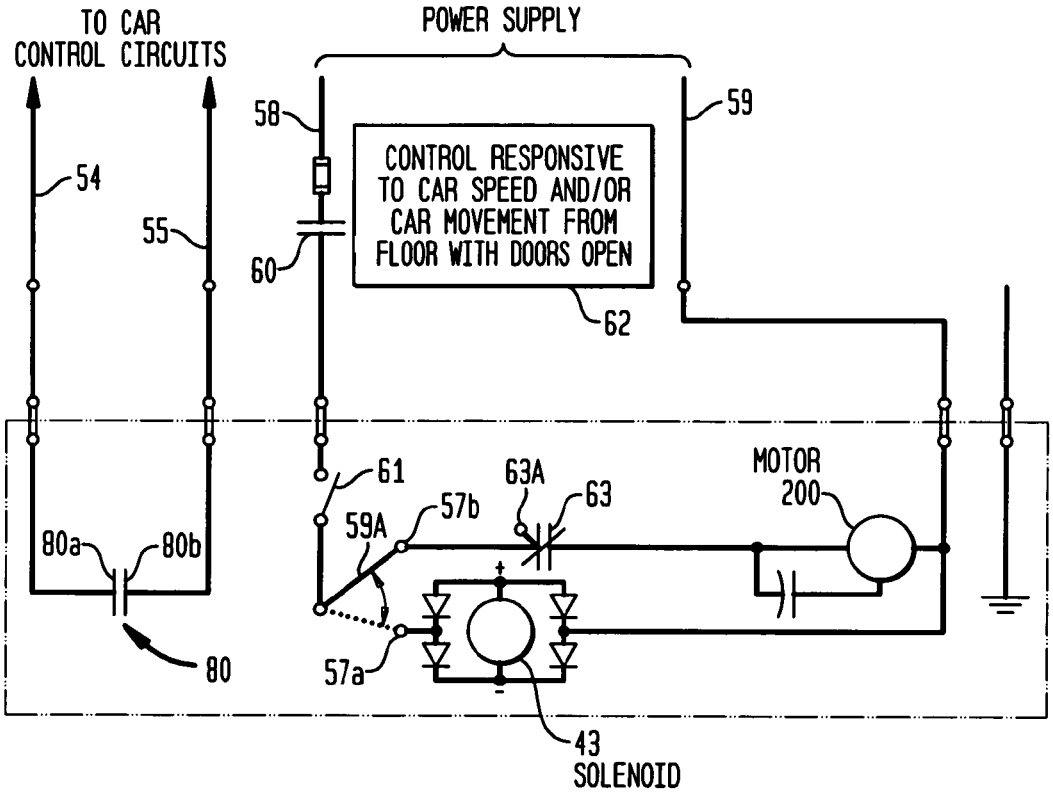
FIG. 10 is a schematic, electrical diagram for use with the apparatus of the invention.

FIG. 10 is a schematic diagram illustrating the electrical circuits that may be added to conventional and known elevator car circuits for controlling the braking apparatus of the invention and for controlling the car operation. The devices within the dashed lines are part of the braking apparatus 1.

Referring to FIG. 10, leads 54 and 55 extend to conventional car circuits which must be completed to permit the elevator car to run. The leads 54 and 55 are in series with the contact element 80 including the contacts 80A and 80B, respectively. The contacts 80A and 80B are electrically coupled to each other only when the springs 15, 16 are compressed. Therefore, the car cannot move if the springs 15 and 16 are not compressed.

Still referring to FIG. 10, leads 58 and 59 extend to the elevator system power supply. The lead 58 is in series with a normally open control switch or contact 60 and a manually operable, normally closed test switch 61. The test switch 61, when opened, releases the springs 15 and 16 and applies the linings 25 and 26 to the ropes 2. The control switch or contact 60 is representative of contacts or circuits required to meet various elevator operating codes. The switch 60 can be opened by either or both of the conventional apparatus in an elevator car system, illustrated by the rectangle 62, which are responsive to car speed, and hence, the speed of the ropes 2, and movement of an elevator car from a floor with its doors open. The speed responsive apparatus can, for example, be an elevator governor whose switch will open when an overspeed occurs, or an electrical generator or encoder connected to the sheave 3 which provides an overspeed signal, which is generated dependent on the speed of rotation of the sheave 3. Conventional elevator systems also have circuits which indicate when a car moves from a floor with its door or doors open. Such circuits can, in an obvious manner, open the control switch 60, and also can be part of other circuits which disconnect power.

When the switches 60 and 61 are closed, the solenoid 43 is energized through a conventional circuit only when the normally open switch 57*a* is closed. When the switch 57*a* is closed, the springs 15 and 16 are compressed, and then held in their compressed state based on the pawl tip 219 engaging with the gear G4, as discussed below. If either of the switches 60 or 61 is opened, the solenoid 43 becomes de-energized, which releases the springs 15 and 16 from the compressed state, thereby causing the linings 25 and 26 to engage the ropes 2 and to arrest movement of the latter.

The motor 200 is connected in series between the power leads 58 and 59 through normally closed switches 57*b* and 63. The switch 63 is opened when the wear of the linings 25 and 26 is excessive, e.g., the follower 17 reaches the limit of its upward movement; or during decompression of the springs 15, 16 when the gear G4 is rotating. The switch 57*b* is opened and the switch 57*a* is closed, when the springs 15 and 16 are compressed and then held in place based on the pawl tip 219 engaging the gear G4. Thus, if the switch 63 is opened, the motor 200 cannot operate to compress the springs 15 and 16, and if the switch 57*b* is opened, which occurs near or at the end of a brake release cycle after the springs 15 and 16 are compressed, power to the motor 200 is disconnected so that the motor 200 stops operating.

From the foregoing, it is apparent that under normal operating conditions, the springs 15 and 16 are compressed and the shoes 22 and 24 have their linings 25 and 26 spaced apart permitting the ropes 2 to pass freely therebetween. However, if the control switch 60 is opened, by reason of either overspeeding of the elevator car 4, in either the up or down direction, or movement of the car 4 from a floor with its doors open, the springs 15 and 16 will be released by the spring within the solenoid 43, and the linings 25 and 26 will grip the ropes 2 and arrest movement of the car 4.

In another aspect of the invention, the braking apparatus 1 includes resilient material, such as a resilient element 90, that is disposed to decrease the amount of an impact force that may be suddenly applied to the gears of the assembly 50 at the end of a brake release cycle. As discussed above, near or at the end of a brake release cycle, the switch combination 57*a*, 57*b* ordinarily disconnects the motor 200 from an energizing source, such that the shaft 30 is no longer driven toward the ends 125, 127 of the slots 121, 123. Referring to FIGS. 2A, 2B, 2C, 3A and 3E, in the event the combination switch 57*a*, 57*b* is misadjusted or not functioning, the motor 200 may continue to operate, such that the shaft 30 continues to be driven at the end of the brake release cycle. In such circumstances, in the absence of a means that would slow the motor and also slow the movement of the shaft 30 as the shaft 30 approaches the ends 125, 127, the shaft 30 would suddenly stop when the shaft 30 comes into contact with a fixed end surface of the apparatus 1 at the ends 125, 127 of the slots 121, 123, respectively. Such contact between the fixed end surface and the moving shaft 30 at the end of the brake release cycle would create a so-called impact force, which may be translated to the rack 156 and the gears of the assembly 50. The impact force would be a function of the mass and speed of the motor 200, the rack 156 and the gears of the assembly 50, and have the potential of causing damage to the gears.

The inventive apparatus 1 may include resilient material which is disposed to reduce the amount of an impact force that is transferred, or avoid an impact force from being transferred, to the gears of the assembly 50. The gears of the assembly 50 are, thus, protected from becoming damaged at the end of a brake release cycle, for example, if a switch that de-energizes the motor 200 near or at the end of a brake release cycle is misadjusted or not functioning properly. The resilient material may also gradually slow movement of the shaft 30 near or at the end of brake release cycle, even if the switch that de-energizes the motor 200 is operating properly.

Referring to FIGS. 2A, 3E, 6A and 9A, in one embodiment, a resilient element 90, for example, a polyurethane plug or spring, is affixed at each of the ends 125, 127 of the slots 121, 123, respectively. The element 90 would contact the shaft 30 when the shaft 30 moves into the slots 121, 123 and approaches the ends 125, 127. Resilient material within the element 90 acts to oppose, and thus slow, movement of the shaft 30 toward the ends 125, 127 near or at the end of the brake release cycle. Consequently, the element 90 would become partially compressed. For example, if the motor 200 remains improperly energized during a brake release cycle, the motor 200 gradually slows down and stalls as the plugs 90 are partially compressed, thereby avoiding too large of an impact force being generated and then acting upon the gears of the assembly 50 to potentially cause damage to the gears.

Figure 2C:
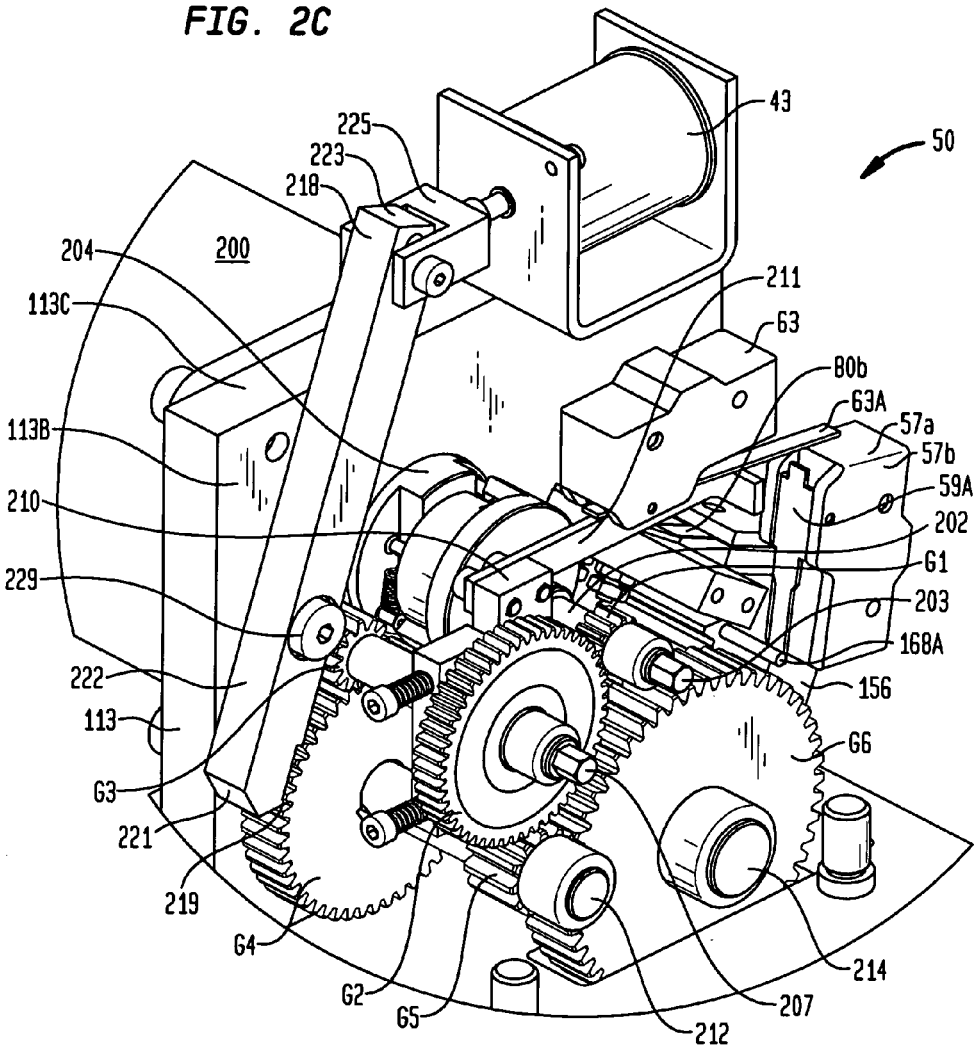
FIG. 2C is an enlarged view of a portion of the apparatus shown in FIG. 2B.
Figure 2D:
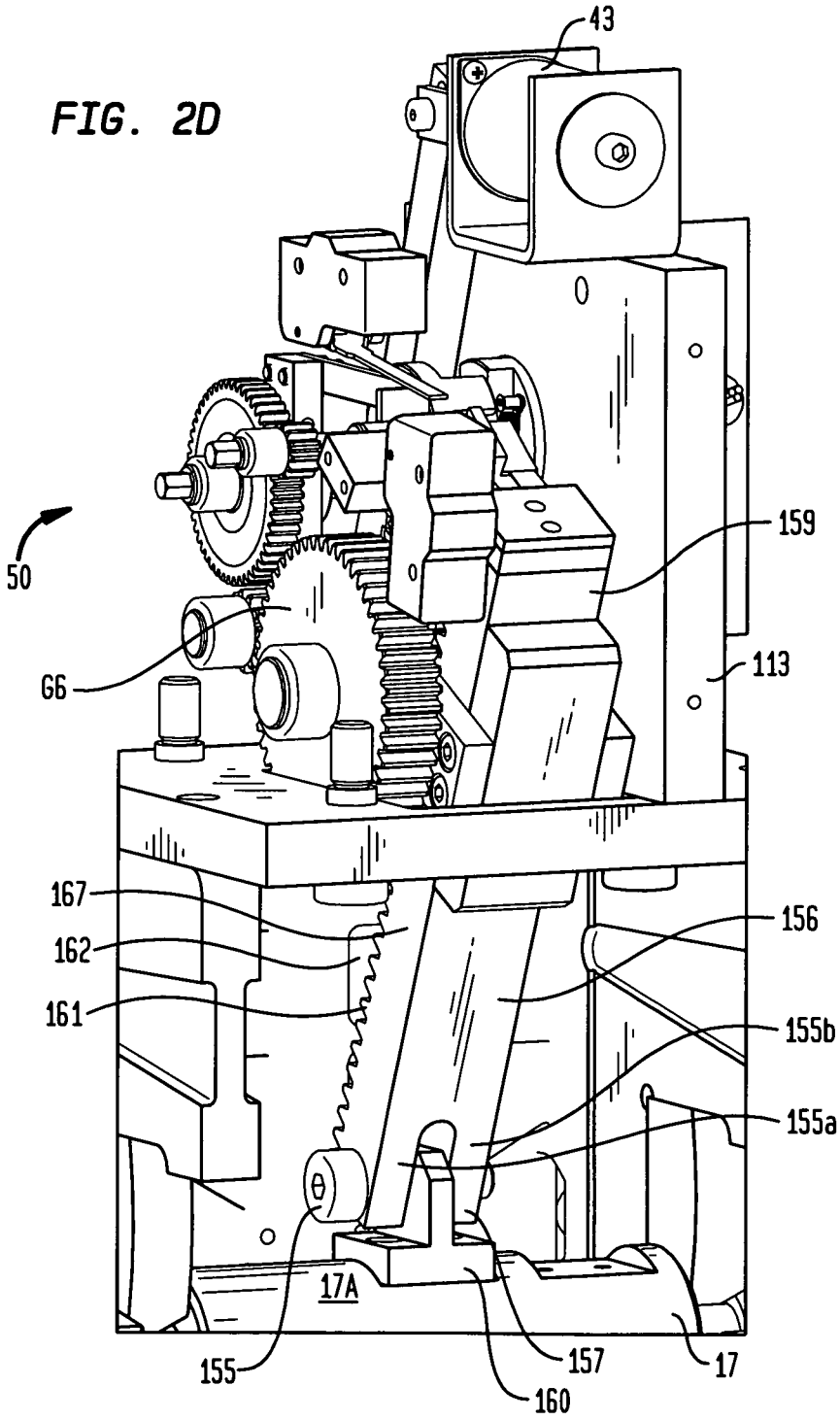
FIG. 2D is an enlarged view of another portion of the apparatus shown in FIG. 2A.

In a further embodiment, referring to FIG. 2D, the mounting plate 160 may include resilient material for decreasing the amount of an impact force that may be translated to the rack 156 and the gears of the assembly 50. Alternatively, resilient material may be affixed to the portion of the shaft 30 that will oppose the ends 125, 127 when the cam follower 17 moves within the slots 121, 123 towards the ends 125, 127.

In a further aspect of the invention, at the start of a brake application cycle, the plugs 90 decompress, which initially accelerates the movement of the shaft 30 away from the ends of the slots and, thus, initially accelerates movement of the brake shoe 22 toward the brake shoe 24.

The following is a detailed description of an exemplary operation of the braking apparatus 1 including the gear assembly 50, the centrifugal clutch 204, the overrun clutch 208, the friction clutch 210 and the resilient element 90.

Referring to FIG. 7, it is initially assumed that the elevator system does not have any faults and the brake apparatus 1 is in the at-rest or brake applied position. In the brake applied position, the springs 15, 16 are partially decompressed, the ropes 2 are held between the shoes 22 and 24 based on a final clamping force that the shoes 22, 24 apply to the ropes 2, and the motor 200 is not energized. Further referring to FIGS. 2B and 4, and assuming the switches 57*b* and 63 are in the normally closed position, when power is supplied to the apparatus 1, the setting of the apparatus 1 is switched from a brake applied position to obtain a brake release position, and a brake release cycle commences. Based on the supply of power, the motor 200 is energized to cause the drive axle to rotate in the direction A. After the motor 200 initially is energized, the clutch 204, in turn, engages the axle 202 once the speed of rotation of the drive axle in the direction A attains a predetermined value. When the axle 202 begins to rotate in the direction A, gear G1 begins to rotate in the same direction. Rotation of the gear G1 in the direction A, in turn, causes the gear G2 to rotate in the direction B, and the roller clutch 208 to engage the gear G2 with the axle 206 to provide that the gear G2 with the axle 206 rotate in the direction B. So long as the gear G2 is rotating in the direction B, the roller clutch 208 maintains the gear G2 engaged with the axle 206. Further referring to FIG. 9A, while the axle 206 is rotating in the direction B, the friction clutch arm 211 remains in a down position, so as not to engage the activating arm 63A of the switch 63.

The gear G3, also rotating in the direction B, in turn, causes the gear G4, and thus the axle 212 and the gear G5, to rotate in the direction A. The rotation of the gear G5 in the direction A, in turn, causes gear G6, and thus the axle 214 and gear G7, to rotate in the direction B.

Figure 9:
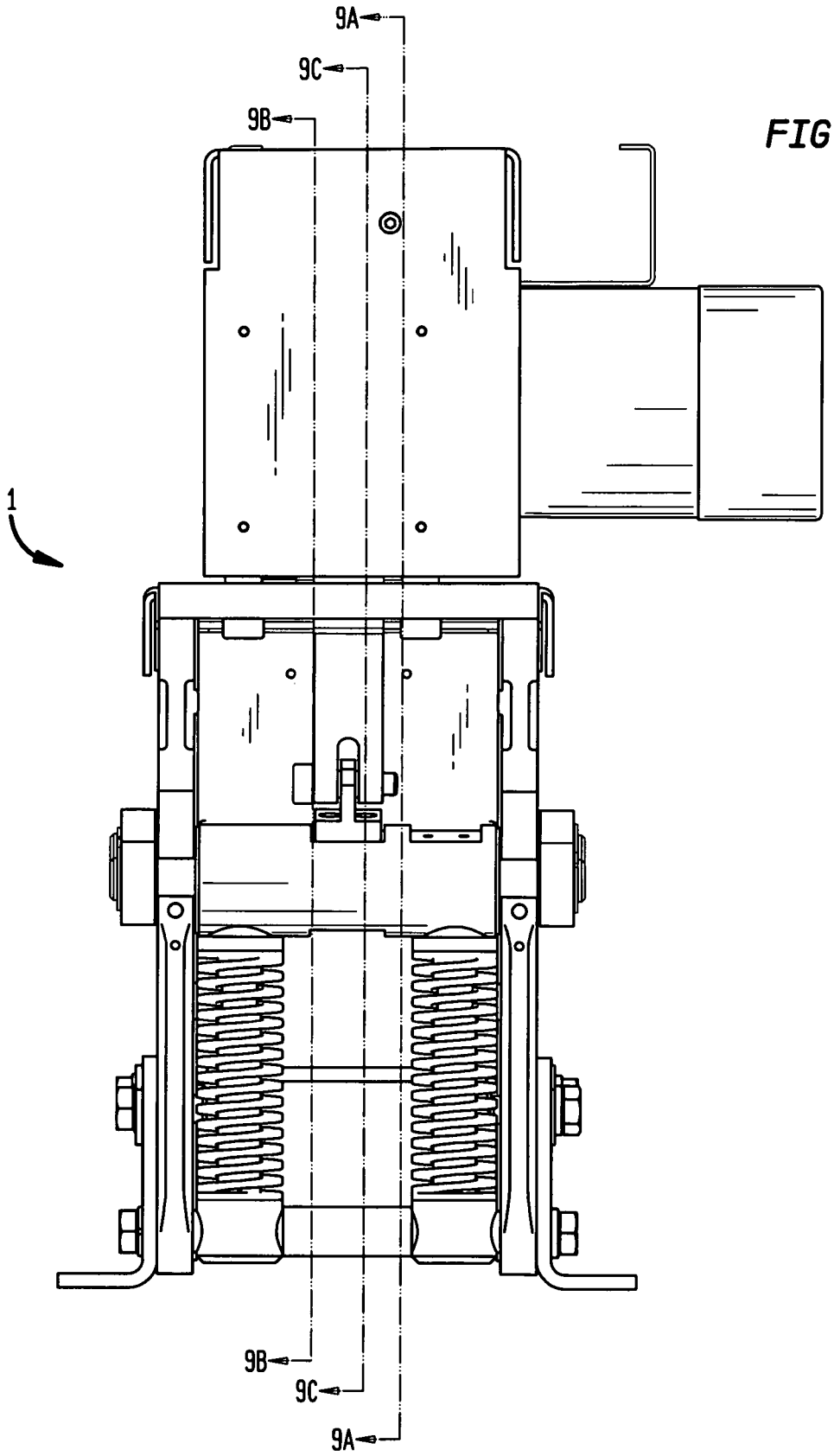
FIG. 9 is an elevation view of a portion of the apparatus shown in FIG. 2A with the parts between the brake release and brake applied position during compression of the springs.
Figure 9A:
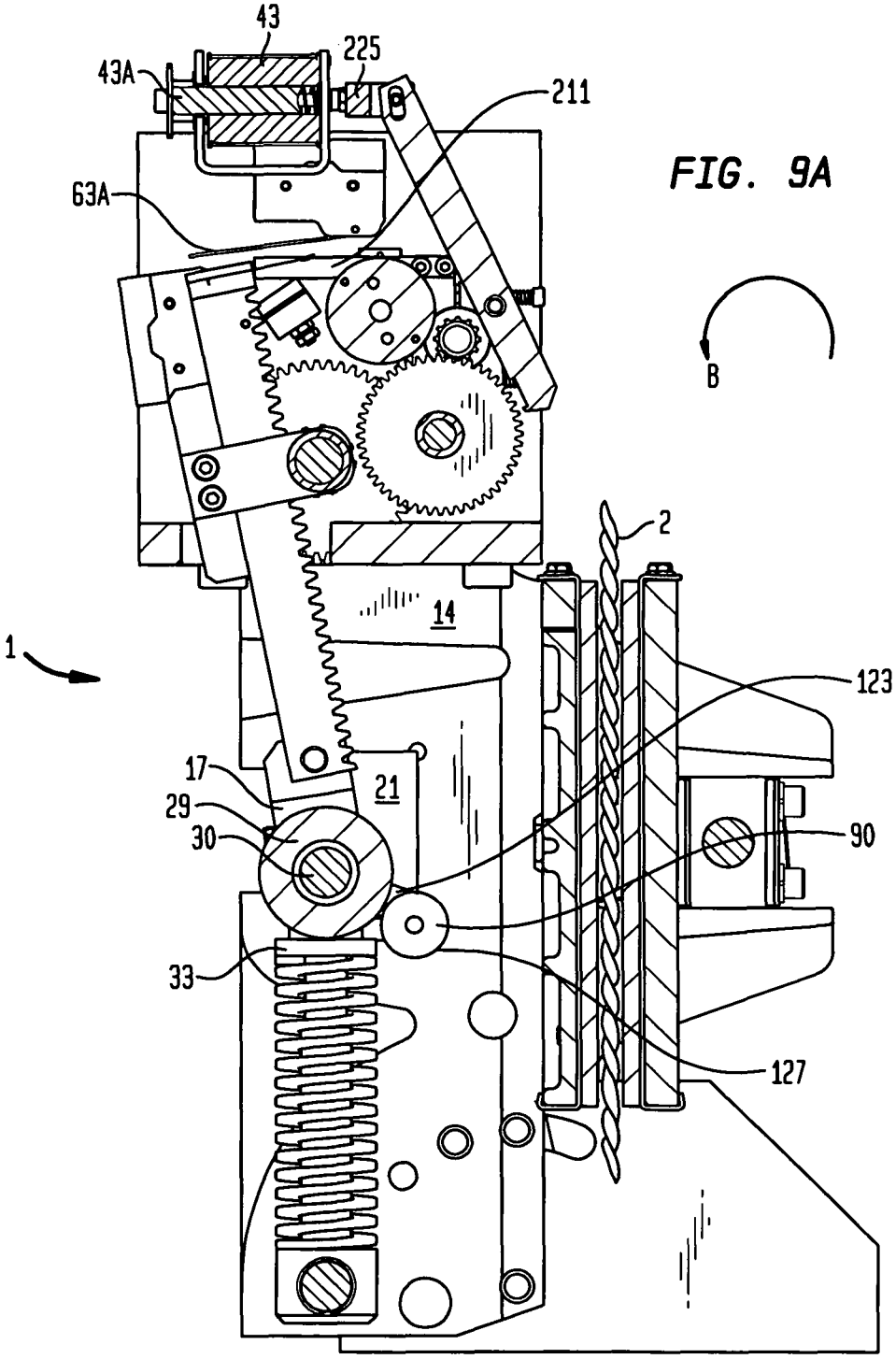
FIGS. 9A, 9B and 9C are side elevation, cross-sectional views of the apparatus shown in FIG. 9 at cross-sectional lines 9A-9A, 9B-9B and 9C-9C, respectively.
Figure 9B:
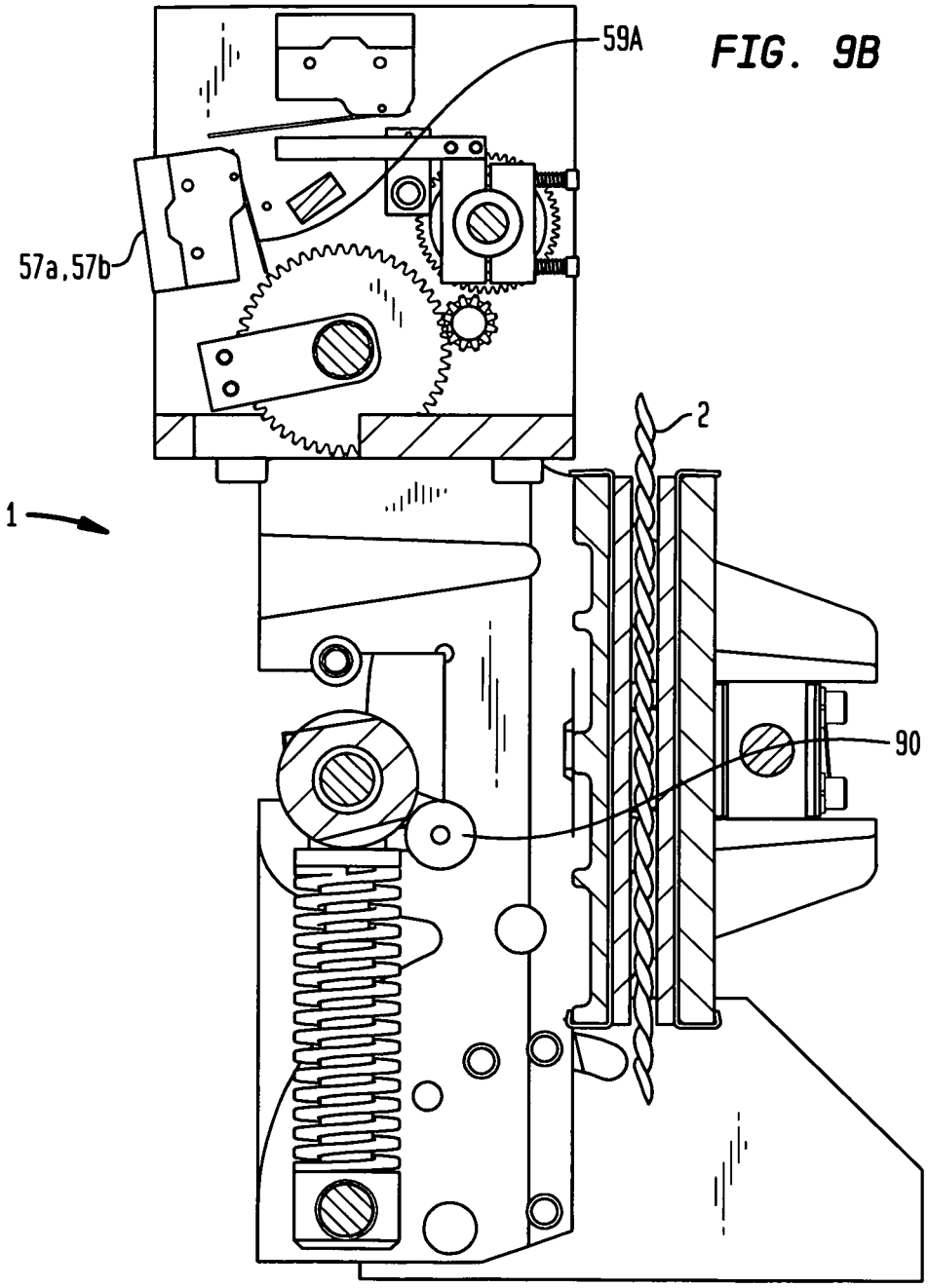
Figure 9C:
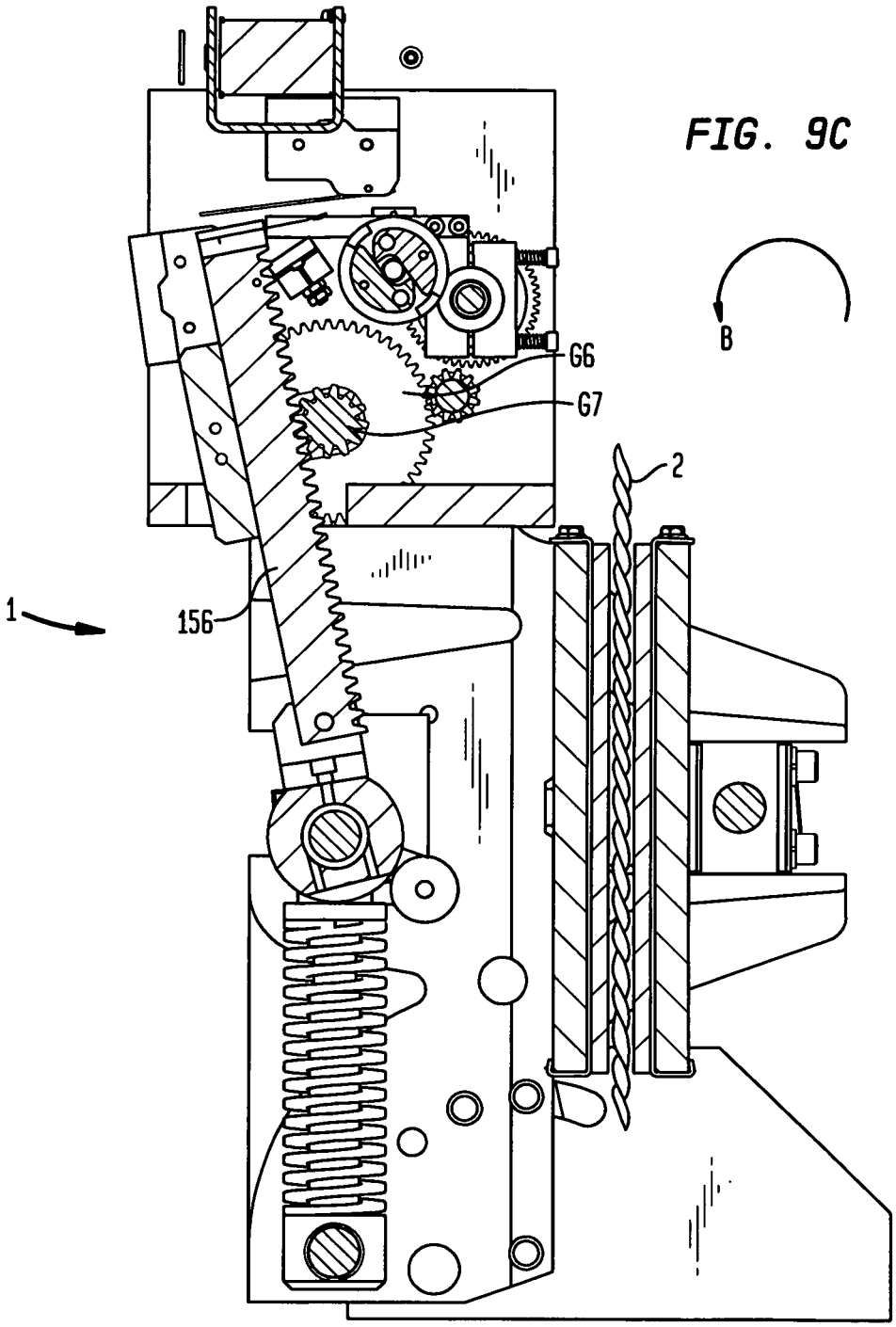

Referring to FIGS. 2A, 9A and 9C, rotation of the gear G7 in the direction B drives the rack 156 downwardly towards the springs 15, 16. Downward movement of the rack 156 moves the cam follower 17 downwardly along the surfaces 20, 21, which in turn causes compression of the springs 15, 16. During compression of the springs 15, 16, the cam follower 17 continues to move into the slots 121, 123 and toward the ends 125, 127.

In one embodiment, the gear assembly 50 is adapted to have a 70:1 gearing ratio and provide that a 1200 rpm, ⅙ hp motor may be used to cause the gears of the gear assembly 50 to apply a compressive force to the spring 15, 16 in excess of 1000 lbs in a brake release cycle.

Near or at the end of the brake release cycle, the shaft 30 contacts and partially compresses the plugs 90. The resilient material in the plugs 90 cushions the movement of the cam follower 17 as the cam follower 17 slows to a stop. The gears, thus, slowly stop their rotation as the springs 15, 16 become fully compressed. Further, the plugs 90 provide that movement of the brake shoe 22 away from the brake shoe 24 is slowed as the springs 15, 16 become fully compressed near or at the end of the brake release cycle. Alternatively, resilient material in the mounting plate 160 may slowly stop the rotation of the gears near or at the end of a brake release cycle. The slow cessation of the rotation of the gears, in turn, decreases the amount of an impact force that may be translated to the gears of the assembly 50 at the end of the brake release cycle.

When the springs 15, 16 are fully compressed, the brake apparatus 1 is in the brake release position, as shown in FIG. 3. Referring to FIG. 3, the plugs 90 are partially compressed and the arm 168 of the rack 156 contacts the contacts 80*a* and 80*b*, closing the contact element 80, which provides that the elevator can run. Also, when the springs 15, 16 are fully compressed, the pin 168A of the rack 156 now contacts the arm 59A, such that the normally closed switch 57*b* is opened, thereby disconnecting power from the motor 200 to turn the motor 200 off, and the normally open switch 57*a* is closed, thereby energizing the solenoid 43.

When the solenoid 43 is energized, the pawl 218 is urged away from the solenoid 43, such that the pawl 218 rotates about the pin 229 and the tip 219 engages the gear G4. When the tip 219 is engaged with the gear G4, the gear G4, and thus the gears G1, G2, G3, G5, G6 and G7 and the axles 202, 206 and 214, are prevented from rotating. The apparatus 1 is now in the latched condition, such that the brake release position is maintained. The cam surface portions 20A, 21A, which contact the axle 30 when the springs 15, 16 are in a compressed state, are suitably shaped (see FIGS. 2A, 3E and 6-9), so that the force that needs to be applied to the pawl 218 to maintain the tip 219 engaged with the gear G4 is small compared to the forces of the springs 15 and 16 when the springs 15 and 16 are fully compressed.

Further, when the axle 202 stops rotating, the weights in the centrifugal clutch 204 move inwardly, thereby disconnecting the drive axle of the motor 200 from the axle 202.

When the braking apparatus 1 is switched from the brake release position (FIG. 3) to obtain the brake applied position, a brake application cycle commences. In a brake application cycle, power is removed from the assembly 50, such as by opening contact 60, so that the solenoid 43 is no longer energized. As soon as the solenoid 43 is no longer energized, the spring of the solenoid 43 is no longer maintained in the compressed condition. The connecting element 225, and thus the end 222 of the pawl 218, move toward the solenoid 43. Referring to FIG. 2C, the tip 219, based on the rotation of the pawl 218 resulting from movement of the end 222 toward the solenoid 43, disengages from the gear G4.

Once the gear G4 has been disengaged from the pawl 218, the apparatus 1 is in the unlatched condition. The springs 15, 16 begin decompressing, forcing the rack 156 upwards, thereby rotating the gears G7, G6, G5, G4, G3, G2 and G1, as described below. The centrifugal clutch 204, which already has disconnected the drive axle of the motor 200 from the gears, provides that the gears can rotate in a direction that is the reverse of the direction in which they rotate during the brake release cycle without rotating the drive axle of the motor 200. It is noted that, in the absence of such means for disconnection of the drive axle of the motor 200 from the gears, when the springs 15, 16 begin decompressing (the brake apparatus is switched from a brake release position to obtain a brake applied position), the drive axle would be rotated in the direction B, which would cause a very slow application of the clamping, thereby rendering the operation of the apparatus 1 undesirable.

Further, when the pawl 218 initially disengages from the gear G4, the plugs 90 decompress. The decompression of the plugs 90 applies a force to the shaft 30, which accelerates the initial movement of the cam follower 17 and the rack 156 upwardly. In turn, the movement of the brake shoe 22 toward the brake shoe 24 is initially accelerated.

Figure 6:
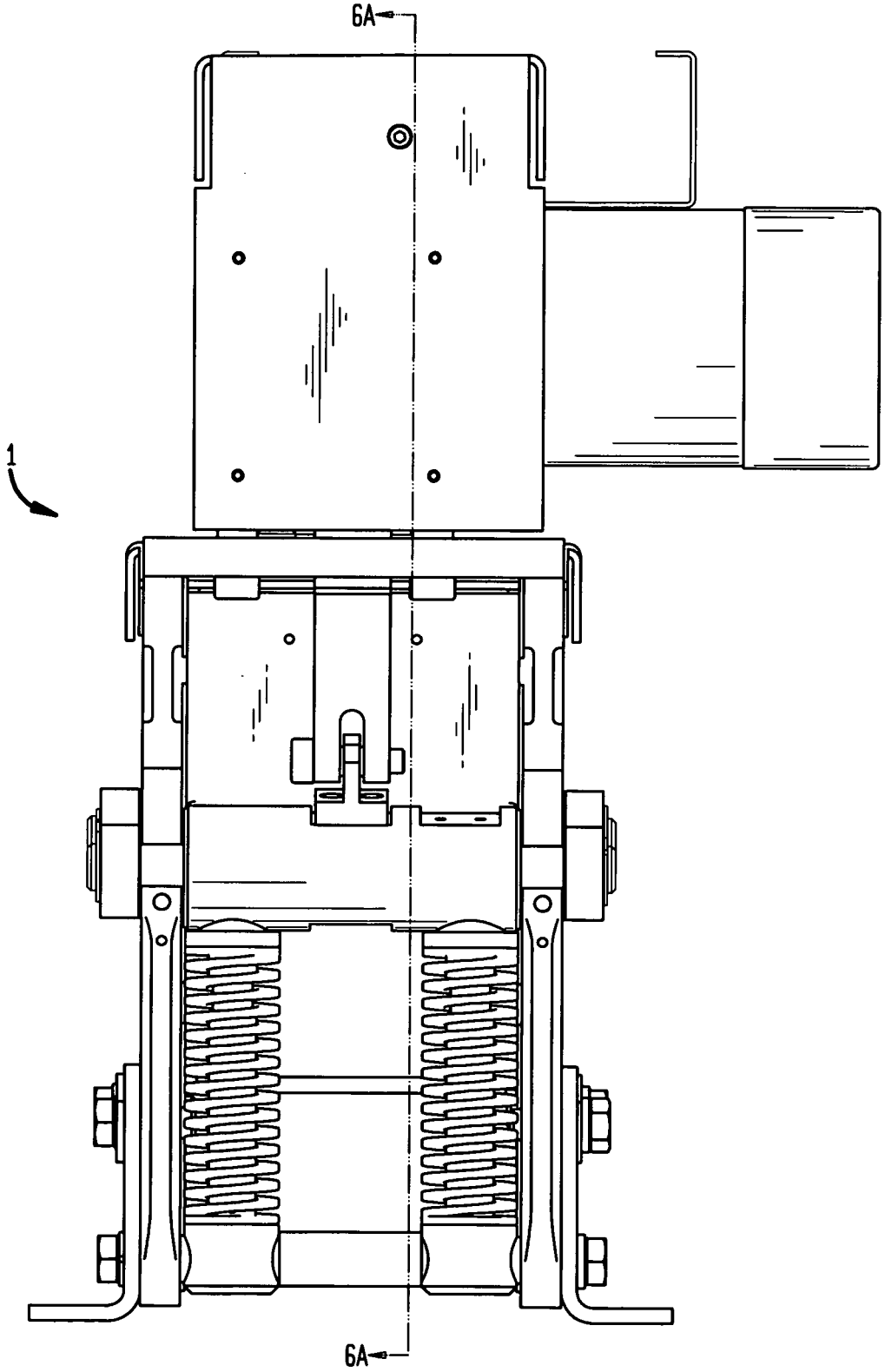
FIG. 6 is an elevation view of a portion of the apparatus shown in FIG. 2A with the parts between the brake release position and brake applied position during decompression of the springs.
Figure 6A:
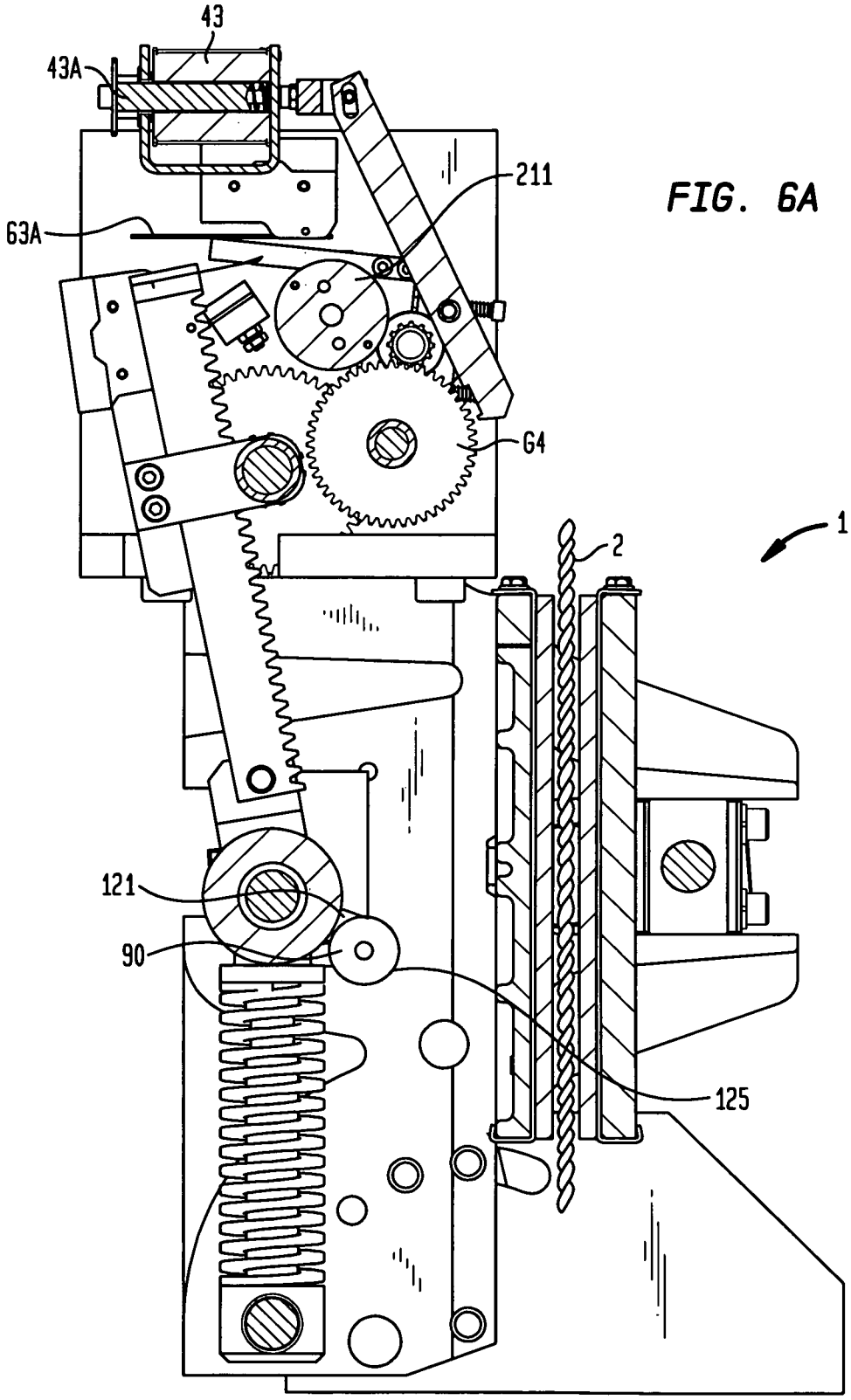
FIG. 6A is a side elevation, cross-sectional view of the apparatus shown in FIG. 6 at cross-sectional line 6A-6A.

Referring to FIGS. 4 and 6A, when the rack 156 moves upwardly, the gears G7 and G6 rotate in the direction A, the gears G5 and G4 rotate in the direction B, the gear G3, the axle 206 and the gear G2 rotate in the direction A and the gear G1 rotates in the direction B. When the gear G2 rotates in the direction A, the friction clutch arm 211 is caused to move upwardly to contact the activating arm 63A of the switch 63, which opens the normally closed switch 63. The switch 63 is held open by the friction clutch arm 211 as long as the gear G2 is rotating in the direction A, thereby preventing the motor 200 from turning on in the event power is inadvertently re-applied at the switch 57*b*. When the rotation of the gear G3 and thus the axle 206 slows or stops, because the rack 156 has reached a position where the brake shoes are applied such that the cam follower 17 no longer moves along the contact surfaces 20, 21, the roller clutch 208 operates to provide that the gear G2, and thus the gear G1, can rotate freely (free wheel). In other words, the gears G1 and G2 rotate independently of the axle 206, after the rotation of the axle 206 has slowed or stopped. The roller clutch 208, thus, prevents shearing of gear teeth of the gears G1 and G2 near the end of a brake application cycle, because the gears G1 and G2 are rotating at a high speed when the gear G3 slows its rotation or stops rotating near the end of a brake application cycle.

In one embodiment, the gears of the assembly 50 are selected to have sizes, masses and locations in relation to one another that achieve quick clamping of the ropes by the brake shoes, such as within about 0.1-0.2 seconds from the start of the brake application cycle.

In one embodiment, the gears of the assembly 50 may be selected to provide that, at the time the brake shoes initially contact the ropes during the brake application cycle, the speeds of rotation of the respective gears are not so high that the braking force applied by the brake shoes may damage the ropes. In a further embodiment, the gear assembly 50 is configured to control the amount of the braking force the brake shoes initially apply to the ropes, such that the braking force initially applied to the ropes is a predetermined percentage of the final clamping force applied to the ropes by the braking shoes at the end of the brake application cycle. The initially applied braking force, for example, may be greater or less than the final clamping force.

In another embodiment, the sizes of the gears G1 and G2 are selected to limit the rotational speeds of the gears G3-G7 of the assembly 50, such that the braking force initially applied to the ropes 2 by the brake shoes does not damage the ropes.

In one embodiment, the first set of gears G1 and G2 is the smallest size of the sets of gears of the assembly 50, with the gear G2 being larger than gear G1. The gears of the first set would rotate at a higher speed than the gears of the second and third gear set, during a brake application cycle as well as during a brake release cycle. The smaller sized gears G1 and G2 substantially define the rotational speeds of the larger size gears G3-G7, when all of the gears G1-G7 are engaged to one another during a brake application cycle.

Further, in the absence of the operation of the roller clutch 208 during a brake application cycle, the sizes of the gears combined with the speed of the gears, especially the gears G1 and G2, and their momentum, may result in destruction or shredding of the gears G2 and G1. Based on the operation of the overrun clutch 208, the gears G1 and G2 are protected from damage, and also do not contribute to the braking force that the brake shoes initially apply to the ropes.

In a further embodiment, the weakest or smallest size gear of the gear assembly 50 is selected to have a mass less than the mass of the other gears. The smallest size gear, however, has a mass sufficient to provide for clamping of the ropes within about 0.1-0.2 seconds from the start of a brake application cycle, and also that a braking force initially applied to the ropes is a predetermined percentage of the final clamping force.

In a further embodiment, the gears have respective sizes and masses such that, during a brake application cycle, the speed of rotation of the gear G1 is about one hundred times the speed of rotation of one or more of the other gears of the assembly 50.

Referring again to FIG. 7, in the brake applied position with the gear G2 no longer rotating, the friction clutch 211 moves downwardly and no longer contacts the activating arm 63A, such that the normally closed switch 63 closes. Based on the closing of the normally closed switch 63, the motor 200 can operate when power is supplied.

Still referring to FIGS. 7 and 9A, without significant wear of the linings 25 and 26, the follower 17 does not reach the top of the cam surfaces 20 and 21. Due to the cam surfaces 20 and 21, the forces of the springs 15 and 16 are multiplied and held constant as the springs 15, 16 extend with wear of the linings 25 and 26 until a predetermined amount of wear is reached. Referring to FIG. 8, when the linings 25 and 26 wear, and become thinner, the follower 17 moves farther up the cam surfaces 20 and 21 to compensate for such wear, and the pin 168A on the rack 156 contacts the arm 63A to open the normally closed switch 63. Therefore, the motor 200 cannot operate and servicing of the apparatus 1 would be required.

It is further to be understood that the selection of the sizes and masses of the respective gears is a function of numerous variables, such as the torque, size and speed of the motor; the number and strength of compressible springs; the desired clamping of the ropes with a final clamping force within about 0.1-0.2 seconds from the start of a brake application cycle; the desired initially applied braking force, which is a percentage of the final clamping force; and the desired final clamping force.

It is also to be understood that the centrifugal clutch 204 may be coupled to any gear of the gear assembly 50, so long as the clutch 204 provides that a motor used to drive the gears of the assembly 50 is disconnected from the assembly 50 during a brake application cycle.

In another embodiment, in the event manual compression of the springs 15 and 16 is desired, a tool, such as ratchet (not shown), may be used to engage either the hex ends 203 and 207 and then rotate the axles 202 or 206 in the direction A or B, respectively.

Referring to FIGS. 2A and 2B, the angle members 11 and 12 are secured to the respective walls 13 and 14 by bolts or cap screws, such as the bolts or cap screws 44 and 45. The bolt 45, and the corresponding bolt securing the angle member 12 to the wall 14, pass through arcuate slots 46 and 47. Therefore, by loosening the bolts 44 and 45, and the corresponding bolts at the wall 14, the walls 13 and 14 and the equipment support thereby, can be tilted as desired to accommodate ropes 2 disposed differently from the positions shown in the drawings. Further, it is to be understood that the braking apparatus 1 may be mounted in any desired orientation, such as sideways or upside down, in relation to the elevator ropes.

In an alternative embodiment, the inventive braking apparatus 1 may be adapted so that each of the brake shoes 22, 24 is movable, and the brake shoes 22, 24 move towards and away from each other during decompression and compression of the springs, respectively. For example, the link 18 side of the apparatus 1 may be adapted to have a construction and operation identical to that of the link 19 side, as described below and illustrated in FIG. 5, such that both of the shoes 22, 24 move during decompression and compression of the springs 15, 16.

Figure 5:
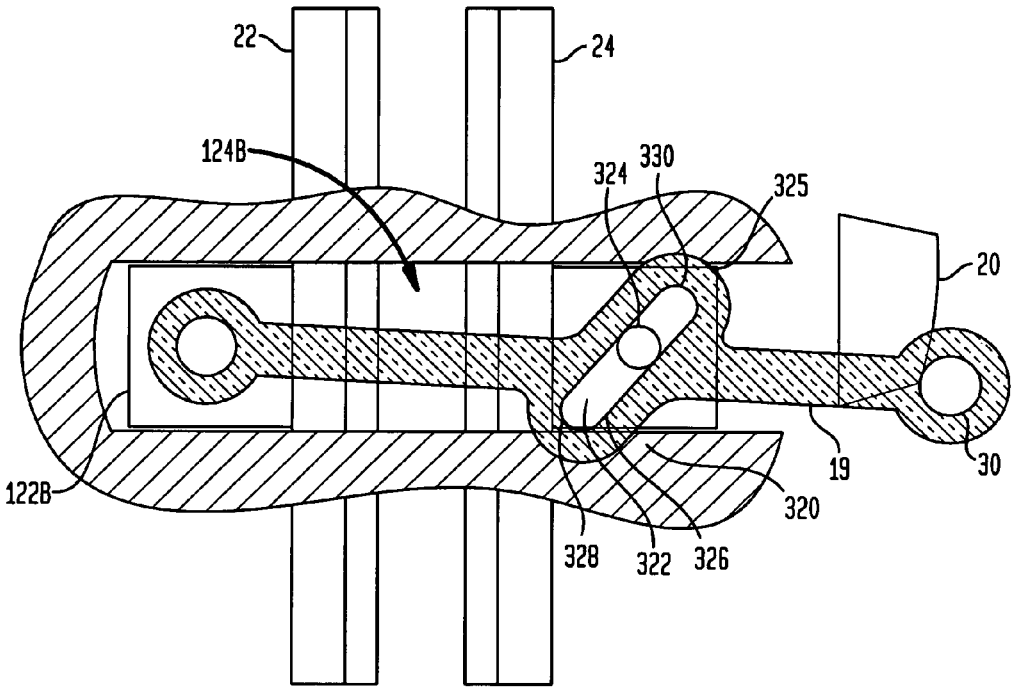
FIG. 5 is a schematic, side elevation view of a portion of an exemplary braking apparatus having two movable brake shoes.

Referring to FIG. 5, the link 19 may include a cam slot link 320 having an inner surface 326 defining a cam slot area 322. The slot area 322 has a lengthwise dimension extending between a bottom end 328 and a top end 330 of the link 30. In addition, a block 325 is affixed to the brake shoe 24, in the same manner that the block 122B is affixed to the shoe 22, such that the block 325, with the affixed shoe 24, is slidable within the recess 124B. The block 325 includes a cam follower 324, which is received in the cam slot area 322 of the link 19. The lengthwise dimension of the area 322 is angled in relation to the lengthwise dimension of the link 19, such that with the link 19 pivotally attached to the block 122B and also attached to the block 325 at the cam slot link 320, the bottom end 328 is closer to the block 122B than the top end 330. Therefore, during partial decompression of the springs 15, 16, as the shaft 30 moves upwardly along the cam surface 20 as shown in FIG. 5, the cam slot link 320 also moves upwardly, the block 122B moves toward the cam surface 20 in the recess 124B, and the cam follower 324 slides along the inner surface 326 toward the bottom end 326 of the cam slot link 320. The cam slot area 322 is angled sufficiently away from the block 122B, such that as the block 122B moves toward the cam surface 20, the block 325 moves in a direction opposite to the cam surface 20, and hence the brakes 22, 24 move toward each other. During compression of the springs 15, 16, when the shaft 30 moves downwardly along the cam surfaces 20, 21, the link 19 also moves downwardly, and the cam follower 324 slides along the inner surface 326 of the link 320 toward the top end 330, such that the blocks 325 and 122B move away from each other, and thus the brakes 22, 24 move away from each other.

In an alternative embodiment, during a brake application cycle, the gear assembly 50 is disengaged from the cam follower 17, and a hydraulic or pneumatic-based system, such as described in U.S. Pat. No. 5,228,540 ("'540 patent"), incorporated by reference herein, may be used to provide that a braking force initially applied by the braking shoes is a predetermined percentage of the final clamping force, thereby avoiding damage to the ropes.

In still another embodiment, a hydraulic or pneumatic-based system, for example, as described in the '540 patent, may be coupled to the cam follower 17 and used to maintain the apparatus 1 in the latched condition.

Figure 11:
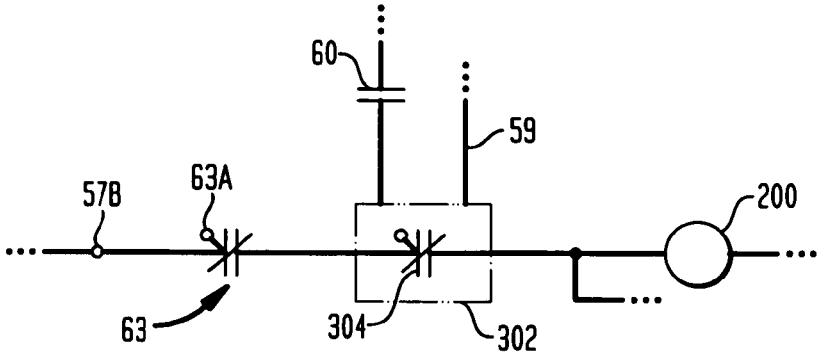
FIG. 11 is a schematic of a portion of an alternative electrical circuit for use with the apparatus of the invention.

In a further embodiment, referring to FIG. 3E, the apparatus 1 may include a sensor 300 positioned at the end 124 of the slot 121, such that the shaft 30 contacts the sensor 300 when the apparatus 1 is in the brake release condition. The sensor 300 is part of a sensor assembly 302 including an electronic timer (not shown) and a normally closed switch 304. The electrical circuit of the apparatus 1, as shown in FIG. 10, may be adapted to include the sensor assembly 302, as shown in FIG. 11. Referring to FIG. 11, the sensor assembly 302 is connected to the lead extending from the switch 60 and the lead 59. In addition, the normally closed switch 304 is electrically connected in series with the motor 200 and the switch 63. The switch 304 is also coupled to the electronic timer. At the start of a brake application cycle, as soon as the shaft 30 no longer contacts the sensor 300, the assembly 302 provides that the timer is activated. Once the timer is activated, the switch 304 is opened, thereby preventing the motor 200 from being energized. Once activated, the timer counts for a predetermined time interval, after which the assembly 302 causes the switch 304 to return to the normally closed position. Consequently, the sensor 300 may provide the same function as the combination of the friction clutch 210 and switch 63, and prevent the motor 200 from being energized during a brake application cycle. In an alternative embodiment, the switch 304 of the assembly 302 may be incorporated into known elevator control circuitry.

In a further embodiment, the braking apparatus 1 may include a locking assembly including a latch coupled to a solenoid, similarly as described in the '540 patent, which may operate to maintain the apparatus 1 in a latched condition when the apparatus 1 is in a brake release position. The locking assembly is mounted to the apparatus 1, as suitable. The locking assembly, however, is not a part of, and also does not interact with, gears of the gear assembly 50.

Thus, a braking apparatus including a gear drive assembly, according to aspects of the invention, provides the following advantages when used to provide emergency breaking, such as for an elevator system. The apparatus is a one piece, self-contained device, which eliminates complexities and potential problems associated with a hydraulic or pneumatic system, including the necessity to locate, mount and wire two separate components. The gear assembly includes sets of gears that provide sufficient force to compress the springs for attaining the brake release position, and provide that the braking force initially applied to ropes by brake shoes is a predetermined percentage of a final clamping force. The gear assembly further provides that a brake applied position may be obtained within a predetermined time from a start of a brake application cycle. Further, the apparatus may include resilient material disposed to slow movement of the cam follower near or at the end of a brake release cycle, as the springs become fully compressed, thereby protecting the gears from any damage or deformation at the end of the brake release cycle. Also, the resilient material accelerates movement of the cam follower when spring decompression is initiated, in other words, when the brake apparatus is switched from a brake release position to obtain a brake applied position, to provide for desired, quick clamping of the ropes by the brake shoes. In addition, a mechanical friction clutch operates to activate a switch to ensure that a motor cannot operate when the gears of the gear assembly are rotating during a brake application cycle. Further, an overrun clutch prevents damage or shearing of gears during the brake application cycle. Also, an excessive wear switch prevents the apparatus from operating if the brake shoe linings are worn to the point that the apparatus may be rendered ineffective.

Also, since the gear assembly is energized to compress the springs 15 and 16, the operation of the brakes in abnormal conditions is not prevented by failure of the gear assembly after the springs 15 and 16 have been compressed. In other words, application of the brakes is not dependent on the electrical operability of the gear assembly once the springs 15 and 16 have been compressed and are held in a compressed state.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A braking apparatus comprising:

a pair of brake shoes having facing surface faces, wherein at least one of the shoes is mounted for movement of its face toward the face of the other of the shoes;

cam means fixedly connected to the at least one of the shoes for moving the face of the at least one of the shoes toward the face of the other of the shoes;

compressible spring means connected to the cam means for actuating the cam means and thereby causing the face of the at least one of the shoes to move toward the face of the other of the shoes;

a gear drive assembly fixedly connected to the cam means and acting through the cam means for compressing the spring means, and operable to control a force of the gear drive assembly continuously acting on the cam means and the at least one of the brake shoes (i) from a start of a brake application cycle to an end of the brake application cycle at which a brake applied position of the apparatus is obtained, wherein the brake application cycle is started when the apparatus is switched from a brake release position to obtain the brake applied position and (ii) from a start of a brake release cycle to an end of the brake release cycle at which the brake release position of the apparatus is obtained, wherein the brake release cycle is started when the apparatus is switched from the brake applied position to obtain the brake release position; and a latch means for holding the spring means in its compressed state after the spring means has been compressed to obtain the brake release position and for releasing the spring means from the compressed state, wherein, upon release of the spring means from the compressed state at the start of the brake application cycle, the spring means actuates the cam means and moves the face of the at least one of the shoes toward the face of the other of the shoes to obtain the brake applied position, wherein the brake applied position is obtained within a predetermined time from the release.

2. The braking apparatus of claim 1, wherein the latch means is for engaging with the cam means or a gear of the gear drive assembly.

3. The braking apparatus of claim 1, wherein the gear drive assembly includes the latch means.

4. The braking apparatus of claim 1, wherein the latch means is for engaging with the cam means.

5. The braking apparatus of claim 1 further comprising:

a resilient element for accelerating movement of the at least one of the shoes toward the other shoe, upon the release of the spring means from the compressed state, by decompressing only at the start of the brake application cycle.

6. The braking apparatus of claim 5, where the resilient element interacts with the cam means.

7. The braking apparatus of claim 1 further comprising:

a resilient element for slowing speed of rotation of a gear of the gear assembly by compressing only near or at the end of the brake release cycle.

8. The braking apparatus of claim 1 further comprising:

clutch means for selectively disengaging from and engaging with at least one of a gear or axle of the gear assembly during decompression and compression of the spring means, respectively.

9. The braking apparatus of claim 8, wherein the gear assembly includes at least first and second gear sets and the clutch means disengages the first gear set from the second gear set near the end of the brake application cycle.

10. The braking apparatus of claim 1 further comprising:

means for preventing a motor engageable to the gear assembly from being energized, when the motor is in a non-energized state and a gear of the gear drive assembly is rotating.

11. The braking apparatus of claim 1 further comprising:

braking force control means for providing that a braking force initially applied by the brake shoes to a clamping surface during the brake application cycle is a predetermined percentage of a final clamping force applied to the clamping surface by the brake shoes at the end of the brake application cycle.

12. The braking apparatus of claim 11, wherein the braking force control means is coupled to the gear assembly.

13. The braking apparatus of claim 11, wherein the gear assembly includes the braking force control means.

14. The braking apparatus of claim 11, wherein, during the brake application cycle, the gear assembly is disconnected from the cam means and the braking force control means operates hydraulically or pneumatically.

15. The braking apparatus of claim 1, wherein the gear assembly includes means for preventing a motor engageable to a gear of the gear assembly from being energized when linings on the respective brakes shoes are worn to a predetermined extent.

16. A braking apparatus comprising:

a pair of brake shoes having facing surface faces, wherein at least one of the shoes is mounted for movement of its face toward the face of the other of the shoes;

cam means fixedly connected to the at least one of the shoes for moving the face of the at least one of the shoes toward the face of the other of the shoes;

a compressible spring means coupled to and for actuating the cam means; and a resilient element for accelerating movement of the at least one of the shoes towards the other of the shoes upon release of the spring means from a compressed state, the resilient element being other than the compressible spring means and for causing a force to act on the cam means in a direction other than a direction a force of the compressible spring means acts on the cam means.

17. The braking apparatus of claim 16, wherein the resilient element is for slowing movement of the cam means near or at an end of a brake release cycle.

18. A method of braking comprising:

driving a gear of a gear set fixedly connected to a cam means and acting through the cam means for compressing at least one compressible spring, wherein the gear set is for controlling a force of the gear set continuously acting on the cam means and at least one brake shoe of a pair of brake shoes (i) from a start of a brake application cycle to an end of the brake application cycle at which a brake applied position of the pair of brake shoes is obtained, wherein the brake application cycle is started when the pair of brake shoes is switched from a brake release position to obtain the brake applied position and (ii) from a start of a brake release cycle to an end of the brake release cycle at which the brake release position of the pair of brake shoes is obtained, wherein the brake release cycle is started when the pair of brake shoes is switched from the brake applied position to obtain the brake release position wherein the cam means is fixedly connected to at least one brake shoe of the pair of brake shoes having facing surface faces, wherein the at least one of the shoes is mounted for movement of its face toward and away from the face of the other of the shoes;

moving the face of the at least one of the shoes away from the face of the other of the shoes, based on the compressing of the spring;

holding the spring in a compressed state after the spring has been compressed; and upon releasing the spring from the compressed state at the start of the brake application cycle, decompressing the spring to actuate the cam means and cause the face of the at least one of the shoes to move toward the face of the other of the shoes to obtain the brake applied position for the brake shoes, wherein the brake applied position is obtained within a predetermined time from the release.

19. The method of claim 18 further comprising;

applying a predetermined percentage of a final clamping force to a clamping surface by the brake shoes when the brake shoes initially contact the clamping surface during the brake application cycle, wherein the final clamping force is applied to the clamping surface at the end of the brake application cycle.

20. The method of claim 18 further comprising:

slowing movement of the at least one of the shoes away from the other of the shoes by a resilient element other than the spring compressing only near or at the end of the brake release cycle.

21. The method of claim 18 further comprising:

accelerating movement of the at least one of the shoes toward the other of the shoes, upon release of the spring from the compressed state, by a resilient element other than the spring decompressing only at the start of the brake application cycle.

22. A braking apparatus comprising:

a pair of brake shoes having facing surface faces, wherein at least one of the shoes is mounted for movement of its face toward the face of the other of the shoes;

cam means fixedly connected to the at least one of the shoes for moving the face of the at least one of the shoes toward the face of the other of the shoes;

compressible spring means connected to the cam means for actuating the cam means and thereby causing the face of the at least one of the shoes to move toward the face of the other of the shoes;

a motor driven gear drive assembly fixedly connected to the cam means and coupled, through the cam means, to the spring means for compressing the spring means, the motor driven gear drive assembly operable to control a force of the motor driven gear drive assembly continuously acting on the cam means and the at least one of the brake shoes (i) from a start of a brake application cycle to an end of the brake application cycle at which a brake applied position of the apparatus is obtained, wherein the brake application cycle is started when the apparatus is switched from a brake release position to obtain the brake applied position and (ii) from a start of a brake release cycle to an end of the brake release cycle at which the brake release position of the apparatus is obtained, wherein the brake release cycle is started when the apparatus is switched from the brake applied position to obtain the brake release position; and a latch means for holding the spring means in its compressed state after the spring means has been compressed to obtain the brake release position and for releasing the spring means from the compressed state, wherein, upon release of the spring means from the compressed state at the start of the brake application cycle, the spring means actuates the cam means and moves the face of the at least one of the shoes toward the face of the other of the shoes to obtain the brake applied position, wherein the brake applied position is obtained within a predetermined time from the release.

23. A braking apparatus comprising:

a pair of brake shoes having facing surface faces, wherein at least one of the shoes is mounted for movement of its face toward the face of the other of the shoes;

cam means fixedly connected to the at least one of the shoes for moving the face of the at least one of the shoes toward the face of the other of the shoes;

a compressible spring means coupled to and for actuating the cam means; and a resilient element for accelerating movement of the at least one of the shoes towards the other of the shoes upon release of the spring means from a compressed state, the resilient element being other than the compressible spring means and compressing only near or at an end of a brake release cycle and decompressing only at a start of a brake application cycle.

* * * * *